US009604463B2

(12) United States Patent
Takagiwa

(10) Patent No.: US 9,604,463 B2
(45) Date of Patent: Mar. 28, 2017

(54) CARTRIDGE CASE

(71) Applicant: BROTHER KOGYO KABUSHIKI KAISHA, Nagoya-shi, Aichi (JP)

(72) Inventor: Yutaka Takagiwa, Kariya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 15/068,146

(22) Filed: Mar. 11, 2016

(65) Prior Publication Data

US 2016/0271961 A1 Sep. 22, 2016

(30) Foreign Application Priority Data

Mar. 18, 2015 (JP) ..... 2015-054104

(51) Int. Cl.
*B41J 2/175* (2006.01)
*B41J 29/02* (2006.01)

(52) U.S. Cl.
CPC ..... *B41J 2/17553* (2013.01); *B41J 2/17513* (2013.01); *B41J 2/17523* (2013.01); *B41J 29/02* (2013.01)

(58) Field of Classification Search
CPC B41J 2/17553; B41J 2/17513; B41J 2/17523; B41J 29/02
See application file for complete search history.

(56) References Cited

FOREIGN PATENT DOCUMENTS

JP 2002-361882 A 12/2002

*Primary Examiner* — Bradley Thies
(74) *Attorney, Agent, or Firm* — Fox Rothschild LLP

(57) ABSTRACT

A cartridge case includes a case body, a shaft portion, a first support portion, a second support portion, and a switching member. The shaft portion includes a shaft support portion and engages with an end portion of an elastic member. The shaft portion is configured to be moved by an energizing force of the elastic member. The switching member is configured to switch a position of the second support portion between an operating position and a released position. The operating position is a position where the second support portion and the first support portion hold the shaft support portion between the second support portion and the first support portion. The released position is a position where the second support portion has moved away from the shaft support portion.

16 Claims, 20 Drawing Sheets

CARTRIDGE CASE

CROSS-REFERENCE TO RELATED APPLICATION

This application claims priority to Japanese Patent Application No. 2015-54104, filed Mar. 18, 2015. The disclosure of the foregoing application is incorporated herein by reference in its entirety.

BACKGROUND

The present disclosure relates to a cartridge case configured to accommodate a liquid-holding container that contains a liquid.

A cartridge case is known that is configured to accommodate a liquid-holding container that contains a liquid. For example, an ink container is known in which, as the amount of a liquid remaining in the interior of an ink pack becomes low, the ink pack is rolled up by the elastic restorative force of an elastic member, pushing the liquid toward a vent plug.

SUMMARY

In a case where an external force is imposed on the ink container, for example, when the ink container is dropped, vibrated etc., there is a possibility that the ink pack will shift within the ink container, making it impossible for the ink pack to be rolled up properly. There is also a possibility that the elastic member will be pushed back in the opposite direction from the vent plug by the rebound force of the ink pack when it has been filled with ink.

Various embodiments of the broad principles derived herein provide a cartridge case configured to properly roll up a liquid-holding container contained in the interior of the cartridge case, even when an external force is imposed on the cartridge case.

The embodiments herein provide a cartridge case that includes a case body, a shaft portion, a first support portion, a second support portion, and a switching member. The case body is provided with a bottom wall, a support portion, and a pair of side walls. The bottom wall is configured to support a liquid-holding container containing a liquid. The bottom wall has a first end portion and a second end portion at opposite ends of the bottom wall. The support portion is provided in the first end portion and configured to support a hollow vent plug provided in the liquid-holding container. The pair of the side walls faces one another from opposite sides of the bottom wall. The shaft portion extends in a first direction. The first direction is the direction in which the pair of the side walls face one another. The shaft portion includes a shaft support portion and engages with an end portion on a second direction side of an elastic member. The second direction is a direction from the first end portion toward the second end portion and orthogonal to the first direction. The shaft support portion is coaxial with the shaft portion and projects toward the pair of the side walls. The limitation "the shaft support portion is coaxial with the shaft portion" means that the shaft support portion is accurately or substantially coaxial with the shaft portion. The elastic member extends in the second direction and is energized to generate a restorative force in a third direction. The third direction is the opposite direction from the second direction. The shaft portion is configured to be moved in the third direction by an energizing force of the elastic member. The first support portion is provided on at least one of the pair of the side walls. The first support portion extends in the second direction and is configured to support the shaft support portion. The second support portion is provided on the opposite side of the shaft support portion from the first support portion. The second support portion and the first support portion are configured to hold the shaft support portion between the second support portion and the first support portion. The switching member has the second support portion. The switching member is configured to switch a position of the second support portion between an operating position and a released position. The operating position is a position where the second support portion and the first support portion hold the shaft support portion between the second support portion and the first support portion. The released position is a position where the second support portion has moved away from the shaft support portion.

The embodiments herein also provide a cartridge case that includes a case body, a shaft portion, and a first support portion. The case body is provided with a bottom wall, a support portion, and a pair of side walls. The bottom wall is configured to support a liquid-holding container containing a liquid. The bottom wall has a first end portion and a second end portion at opposite ends of the bottom wall. The support portion is provided in the first end portion and configured to support a hollow vent plug provided in the liquid-holding container. The pair of the side walls faces one another from opposite sides of the bottom wall. The shaft portion extends in a first direction. The first direction is the direction in which the pair of the side walls face one another. The shaft portion includes a shaft support portion and engages with an end portion on a second direction side of an elastic member. The second direction is a direction from the first end portion toward the second end portion and orthogonal to the first direction. The shaft support portion is a gear that is coaxial with the shaft portion and that projects toward the pair of the side walls. The limitation "the shaft support portion is a gear that is coaxial with the shaft portion" means that the shaft support portion is a gear that is accurately or substantially coaxial with the shaft portion. The elastic member extends in the second direction and is energized to generate a restorative force in a third direction. The third direction is the opposite direction from the second direction. The shaft portion is configured to be moved in the third direction by an energizing force of the elastic member. The first support portion is provided on at least one of the pair of the side walls. The first support portion is extending in the second direction. The first support portion is configured to support the shaft support portion. The first support portion is a rack. The rack has a plurality of teeth along the second direction. The plurality of teeth is configured to engage with the shaft support portion.

The embodiments herein also provide a cartridge case that includes a case body, a shaft portion, a first support portion, and a first anti-slip member. The case body is provided with a bottom wall, a support portion, and a pair of side walls. The bottom wall is configured to support a liquid-holding container containing a liquid. The bottom wall has a first end portion and a second end portion at opposite ends of the bottom wall. The support portion is provided in the first end portion and configured to support a hollow vent plug provided in the liquid-holding container. The pair of the side walls faces one another from opposite sides of the bottom wall. The shaft portion extends in a first direction. The first direction is the direction in which the pair of the side walls face one another. The shaft portion includes a shaft support portion and engages with an end portion on a second direction side of an elastic member. The second direction is a direction from the first end portion toward the second end portion and orthogonal to the first direction. The shaft support portion is coaxial with the shaft portion and projects toward the pair of the side walls. The limitation "the shaft support portion is coaxial with the shaft portion" means that the shaft support portion is accurately or substantially coaxial with the shaft portion. The elastic member extends in the second direction and is energized to generate a restorative force in a third direction. The third direction is the opposite direction from the second direction. The shaft portion is configured to be moved in the third direction by an energizing force of the elastic member. The first support portion is provided on at least one of the pair of the side walls. The first support portion extends in the second direction and is configured to support the shaft support portion. The first anti-slip member is provided in the bottom wall. The first anti-slip member is configured to support the liquid-holding container along the second direction.

BRIEF DESCRIPTION OF THE DRAWINGS

Embodiments of the present embodiment will be described below in detail with reference to the accompanying drawings in which.

DETAILED DESCRIPTION

An embodiment of the present disclosure will be explained with reference to the drawings. The general configuration of a printer 1 will be explained with reference to FIG. 1. In the explanation that follows, the upper side, the lower side, the lower right side, the upper left side, the upper right side, and the lower left side in FIG. 1 respectively define the upper side, the lower side, the right side, the left side, the rear side, and the front side of the printer 1.

Figure 1:
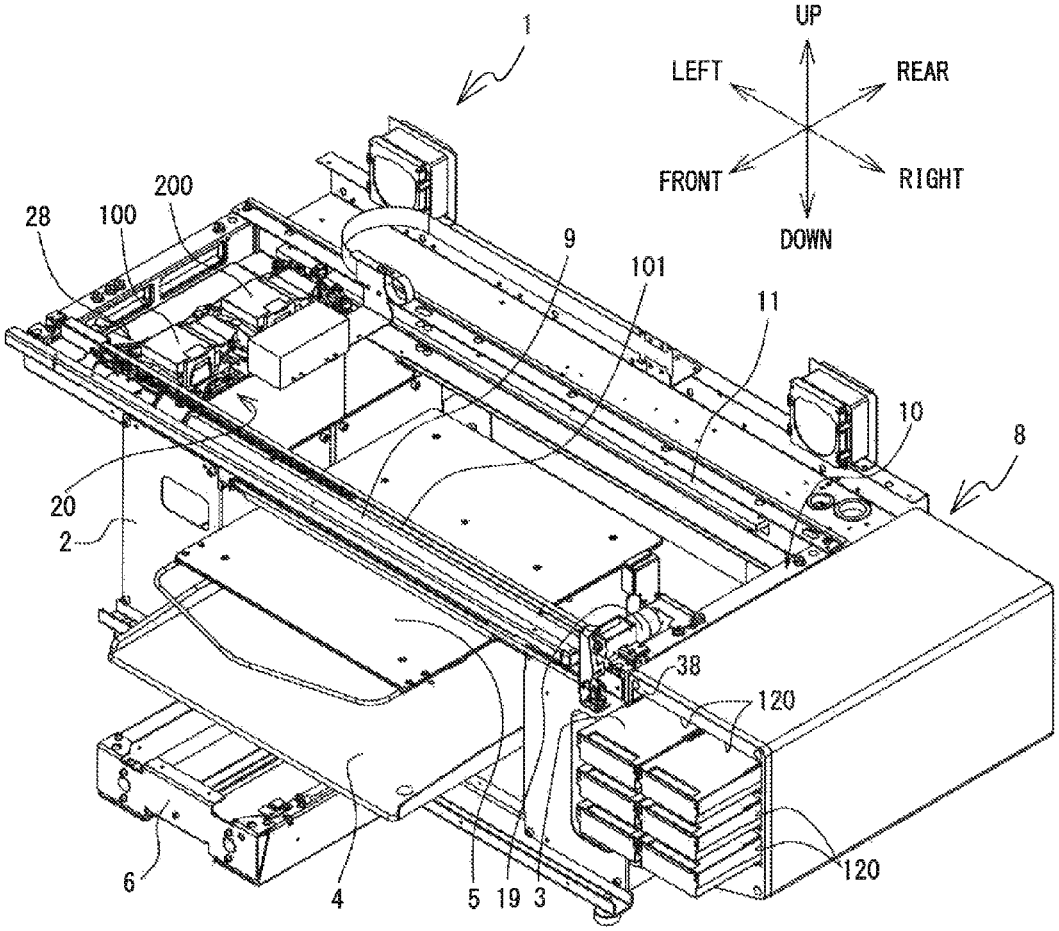
FIG. 1 is an oblique view of a printer.

As shown in FIG. 1, the printer 1 is an inkjet printer that, by discharging a liquid ink, performs printing on a cloth (not shown in the drawings), such as a T-shirt or the like, that is a printing medium. The printer 1 may also use paper or the like as the printing medium. The printer 1 is configured to print a color image on the printing medium by discharging downward five types of the ink with different colors (white, black, yellow, cyan, and magenta).

The printer 1 is provided with a housing 2, a platen drive mechanism 6, a platen 5, a tray 4, a frame body 10, a guide shaft 9, a rail 11, a carriage 20, a support portion (not shown in the drawings), head units 100, 200, a drive belt 101, and a drive motor 19.

An operation portion (not shown in the drawings) that includes a display, an operation button, and the like for performing operations of the printer 1 is provided on the front side of the right portion of the housing 2.

The platen drive mechanism 6 is provided in its interior with a pair of guide rails (not shown in the drawings) that extend from the front to the rear. The pair of the guide rails support the platen 5 and the tray 4 such that they may move toward the front and the rear. The platen drive mechanism 6 moves the platen 5 and the tray 4 toward the front and the rear of the housing 2 along the pair of the guide rails, using as its drive source a motor (not shown in the drawings) that is provided at the rear edge of the platen drive mechanism 6. The platen 5 has a substantially rectangular plate shape in a plan view, with its long axis extending in the front-rear direction of the housing 2. The platen 5 is provided below the frame body 10, which will be described later. The printing medium, which is a cloth such as a T-shirt or the like, for example, is placed on the top face of the platen 5. The tray 4 is substantially rectangular in a plan view, and it is provided below the platen 5. When an operator places a T-shirt or the like on the platen 5, the tray 4 receives the sleeves of the T-shirt or the like, protecting the sleeves or the like such that they do not fall into the interior of the housing 2.

The frame body 10 has a substantially rectangular frame shape in a plan view. The frame body 10 is disposed in the upper portion of the housing 2. The frame body 10 supports the guide shaft 9 and the rail 11 on its inner sides. The guide shaft 9 is a shaft member that extends from left to right. The rail 11 is a rod-shaped member that extends from left to right, and it is disposed opposite the guide shaft 9. The guide shaft 9 and the rail 11 are set apart from one another to the front and the rear, respectively.

The carriage 20 is supported such that it may be conveyed to the left and the right along the guide shaft 9. The head units 100, 200 are mounted on the carriage 20. A head portion (not shown in the drawings) is provided on the bottom face of each one of the head units 100, 200. The head portion is provided with a plurality of tiny nozzles, and droplets of ink are discharged downward from the nozzles by the operation of piezoelectric elements.

The drive belt 101 is belt-shaped and spans the inner side of the frame body 10 from left to right. The drive motor 19 is provided on the front right side of the inner side of the frame body 10. The drive motor 19 is provided to the rear of the guide shaft 9 and in front of the rail 11. The drive motor 19 is coupled to the carriage 20 through the drive belt 101. When the drive motor 19 drives the drive belt 101, the carriage 20 is moved reciprocally to the left and the right, and the head portions of the head units 100, 200 also move reciprocally to the left and the right. As the platen 5 conveys the printing medium in toward the front and the rear, the printer 1 performs printing on the printing medium by discharging the ink from the head portions, which move reciprocally to the left and the right.

A cartridge mounting portion 8 is provided on the right side of the printer 1. The cartridge mounting portion 8 is supported by a housing that is not shown in the drawings. The inks are supplied to the head portions of the head units 100, 200 from cartridges 3 that are mounted in the cartridge mounting portion 8. A plurality (in the present embodiment, six) of the cartridges 3 may be set in the cartridge mounting portion 8. A frame portion 38 is provided in the front portion of the cartridge mounting portion 8. Openings 120 are provided in the frame portion 38, arrayed in three rows from top to bottom and two columns from left to right. The cartridges 3 are configured to be inserted into and removed from the openings 120. When the cartridge 3 is mounted in the cartridge mounting portion 8, a hollow needle (not shown in the drawings) for drawing a liquid out of a liquid-holding container 31 that is contained in the cartridge 3 pierces a rubber plug (not shown in the drawings) that is disposed in a vent plug 7 (refer to FIG. 2) of the liquid-holding container 31. In this manner, the cartridge 3 is set into the cartridge mounting portion 8.

Figure 2:
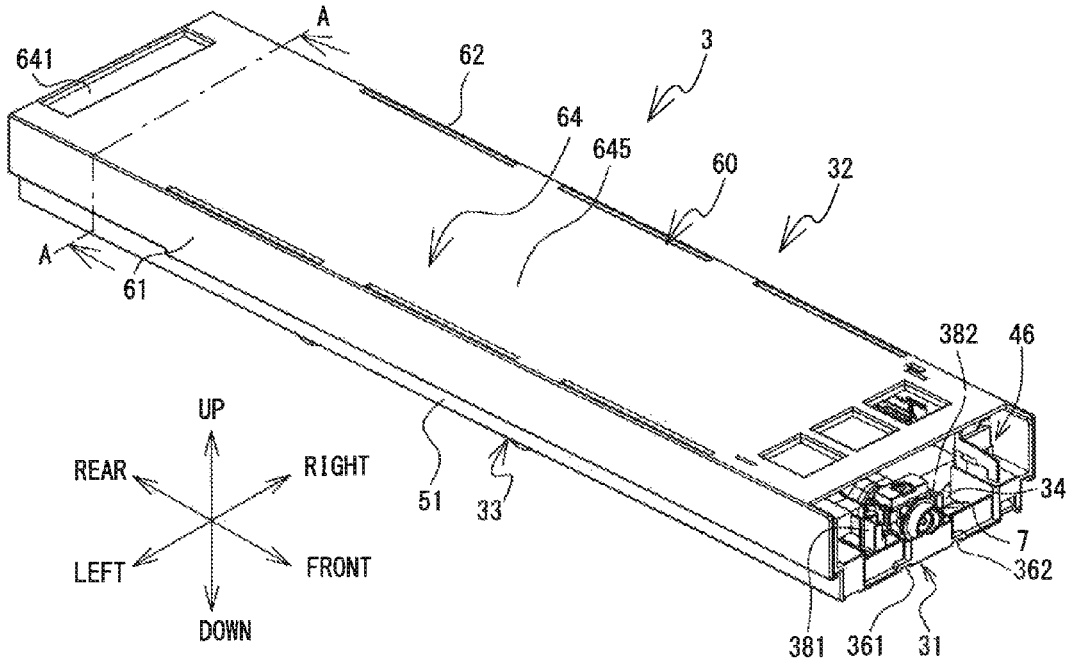
FIG. 2 is an oblique view of a cartridge from above, in which a second case is in a closed position.
Figure 3:
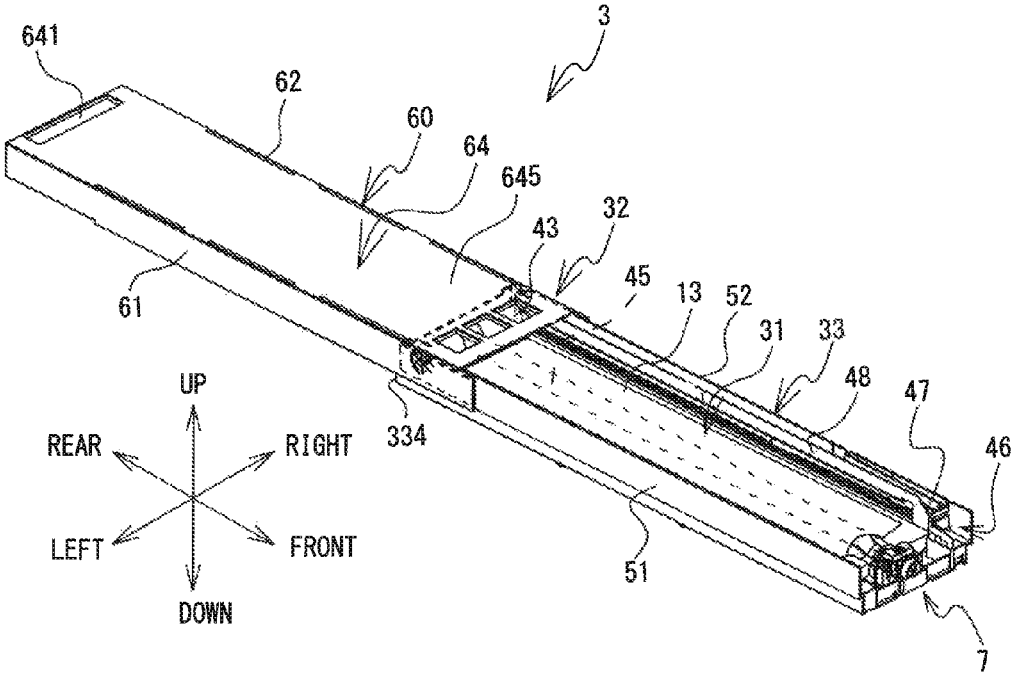
FIG. 3 is an oblique view of the cartridge from above, in which the second case is in an open position.
Figure 9:
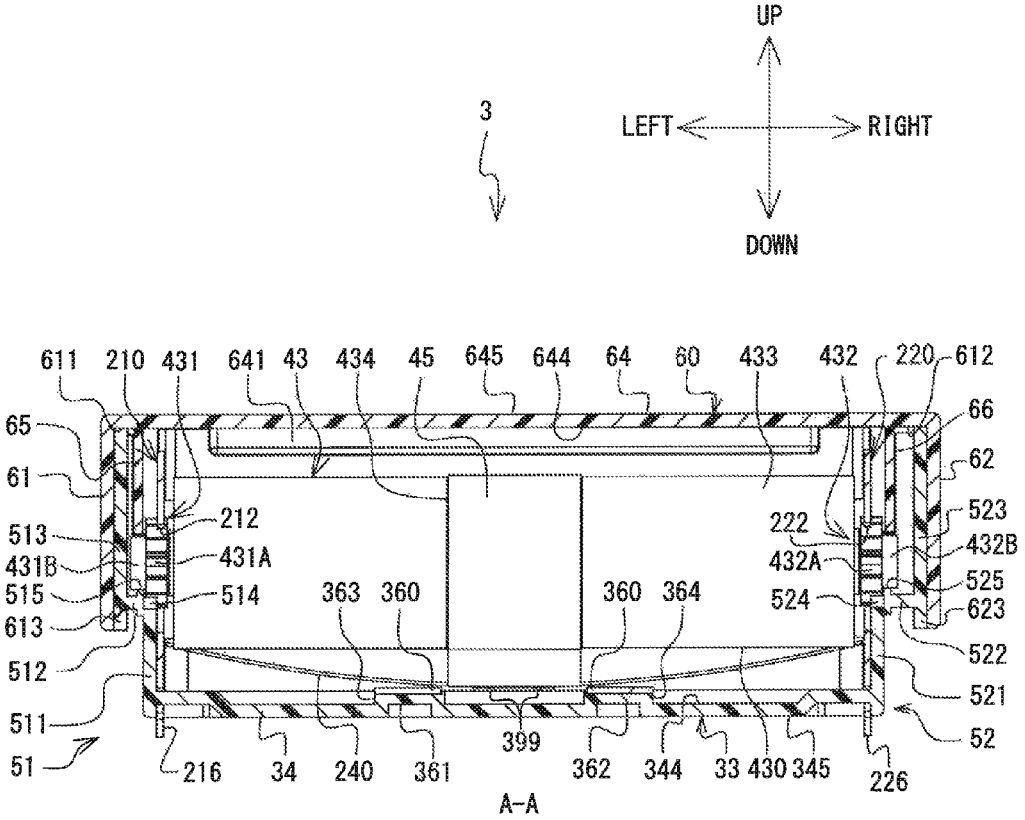
FIG. 9 is a section view from the direction of arrows on a line A-A in FIG. 2.
Figure 11:
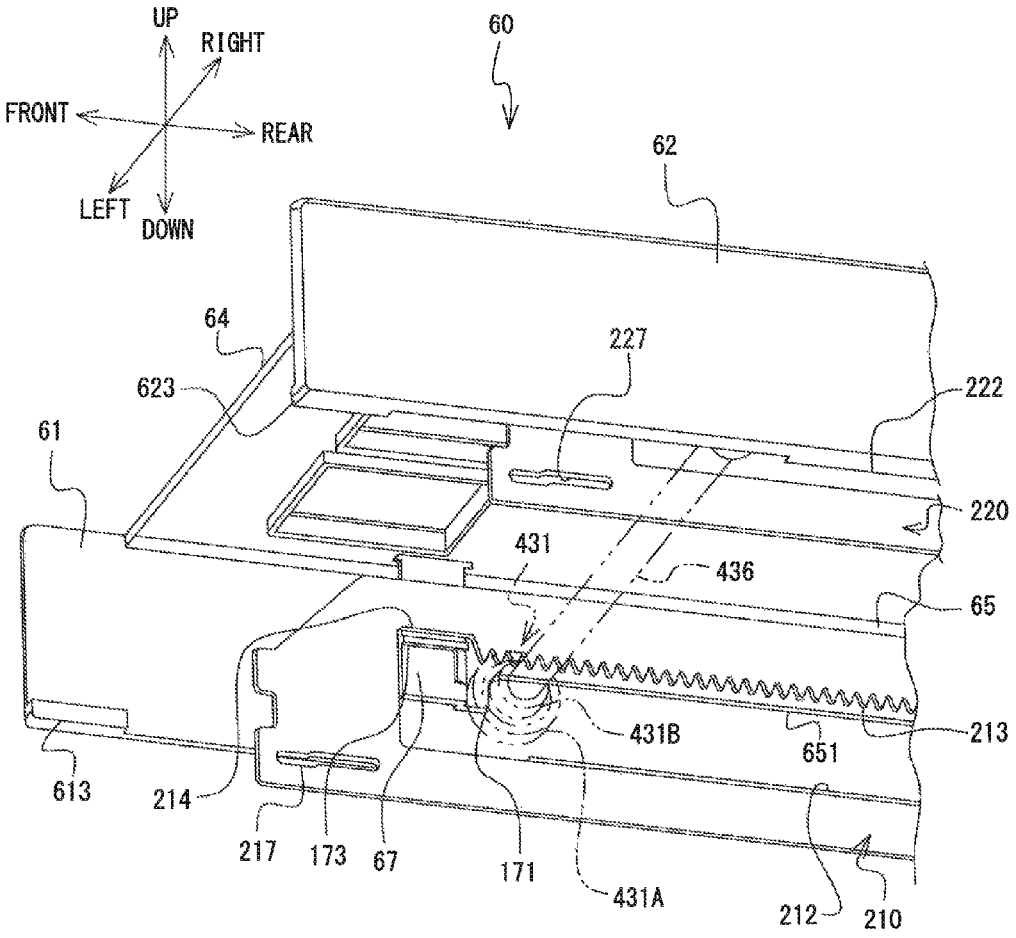
FIG. 11 is an oblique view of the front end of the second case and the front end of a presser plate.

The cartridge 3 will be explained. In the explanation that follows, the upper side, the lower side, the lower right side, the upper left side, the upper right side, and the lower left side in FIG. 2 respectively define the upper side, the lower side, the front side, the rear side, the right side, and the left side of the cartridge 3. FIG. 9 does not show a liquid-holding bag 13. FIG. 11 uses virtual lines to show a shaft support portion 431 and a coupling shaft 436 of a shaft portion 43. As shown in FIGS. 2 and 3, the cartridge 3 is provided with the liquid-holding container 31 and a case 32 that is contained in the interior of the liquid-holding container 31.

Figure 4:
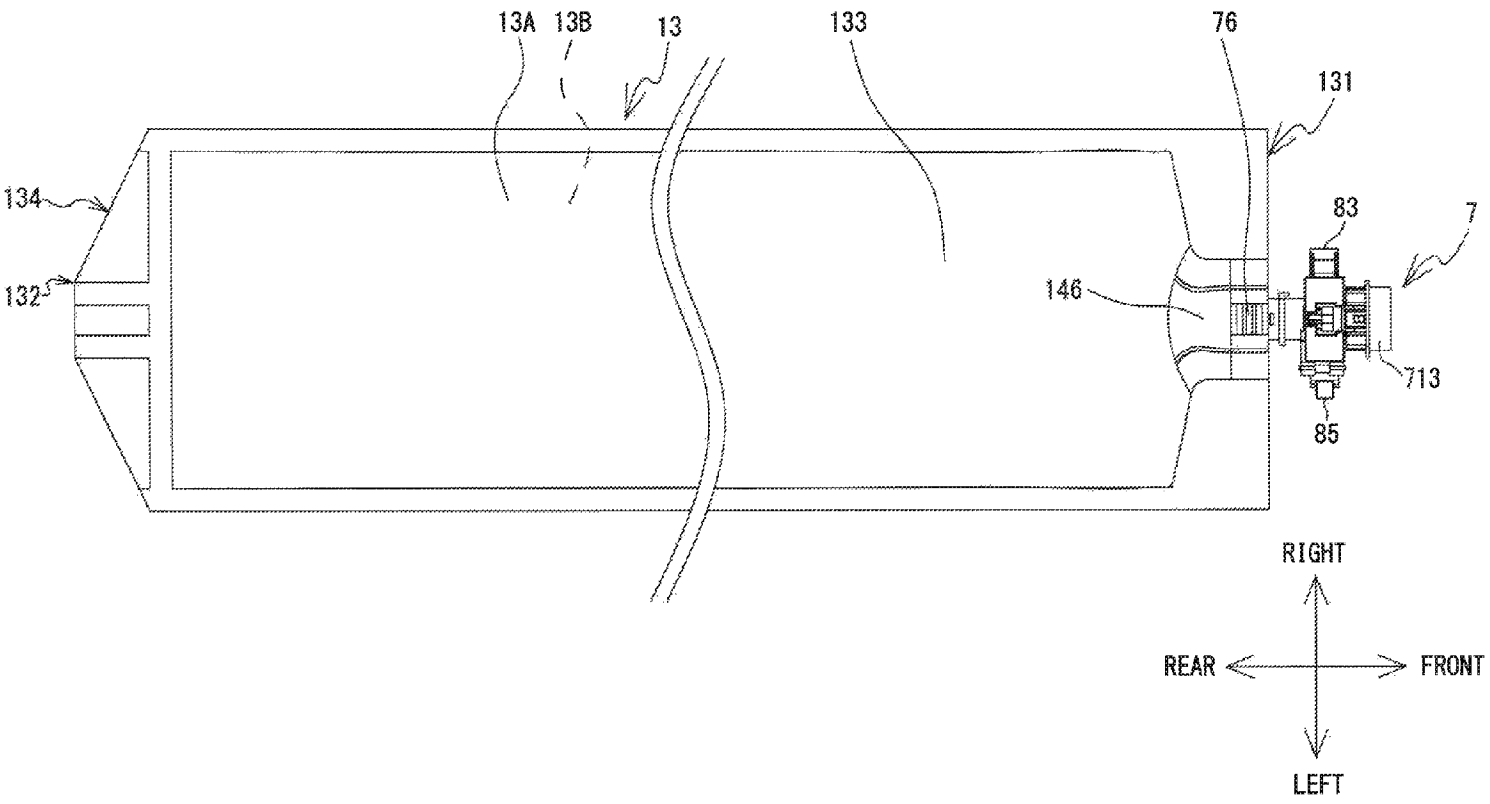
FIG. 4 is a plan view of a liquid-holding container.
Figure 5:
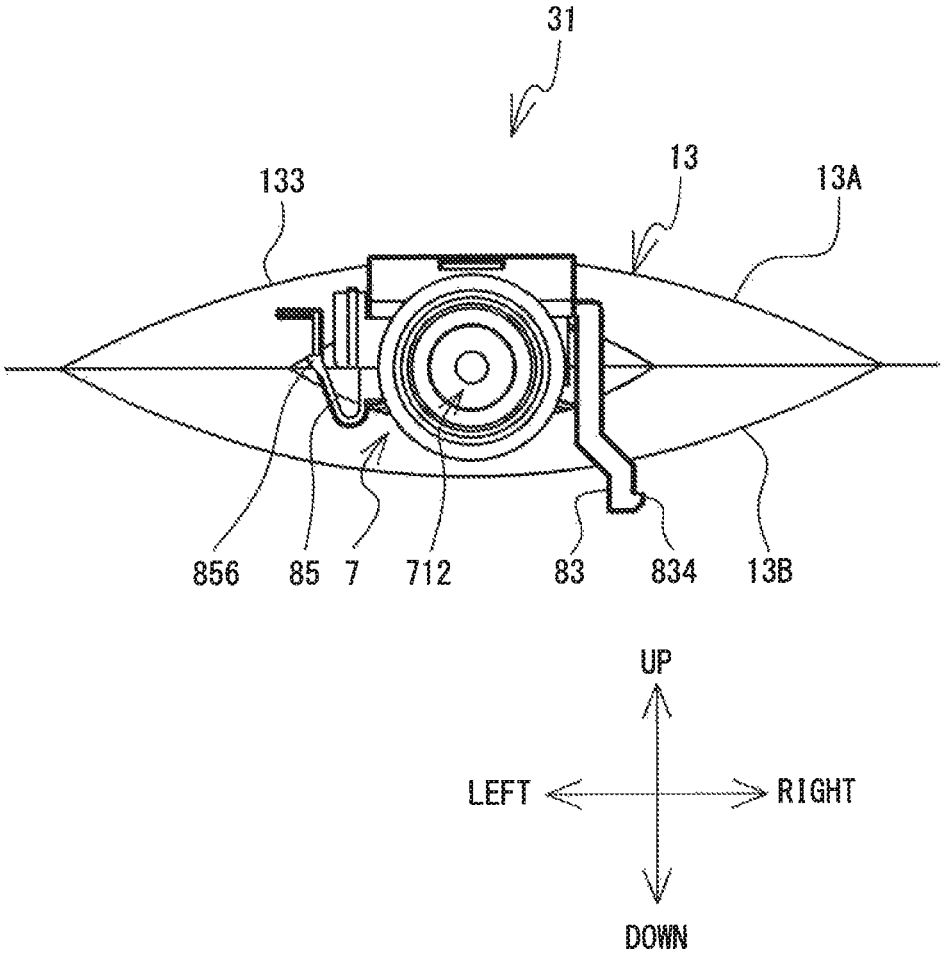
FIG. 5 is a front view of the liquid-holding container.

As shown in FIGS. 4 and 5, the liquid-holding container 31 is provided with the liquid-holding bag 13 and the vent plug 7. The liquid-holding bag 13 is a bag-shaped container that is formed from two sheets 13A, 13B, each of which is made of resin and is flexible and rectangular. The peripheral edges of the two sheets 13A, 13B are disposed such that one face of each sheet is opposite one face of the other sheet, and the peripheral edges are connected. The liquid-holding bag 13 extends from the front to the rear.

The liquid-holding bag 13 is provided with a liquid-holding portion 133 and an extension portion 134. A liquid is contained in the interior of the liquid-holding portion 133. The liquid may be an ink, a discharge agent that decolorizes a dyed cloth, or the like. The extension portion 134 is a part of the liquid-holding bag 13 that does not contain any ink. The extension portion 134 is provided in a rear end portion 132 of the liquid-holding bag 13 and extends toward the rear from the liquid-holding portion 133. An insertion portion 76 of the vent plug 7 is inserted between the sheets 13A, 13B in a front end portion 131 of the liquid-holding bag 13. A curved region 146 is provided in the front end portion 131 and is formed by curving the sheets 13A, 13B around the insertion portion 76 in directions (upward and downward) in which they are separated from one another. The curved region 146 extends to the rear of the insertion portion 76.

The vent plug 7 is connected to the front end portion 131 of the liquid-holding bag 13 and extends toward the front and the rear. The vent plug 7 is provided with a tip portion 713, a first vent plug protruding portion 83, a second vent plug protruding portion 85, and the insertion portion 76. The tip portion 713 is provided on the front side of the vent plug 7 and has a cylindrical shape that extends toward the front and the rear. A hollow portion 712 is provided in the vent plug 7 toward the rear from the center of the tip portion 713 in a front view. The hollow portion 712 connects the interior of the liquid-holding portion 133 to the outside of the vent plug 7. The rubber plug (not shown in the drawings) is disposed in the interior of the hollow portion 712 and seals the hollow portion 712 such that the ink inside the liquid-holding bag 13 does not leak out.

The first vent plug protruding portion 83 and the second vent plug protruding portion 85 are provided on the rear side of the tip portion 713. The first vent plug protruding portion 83 is provided on the right side of the vent plug 7. The first vent plug protruding portion 83 extends downward from the right side of the vent plug 7, then extends obliquely downward toward the right, after which its lower end extends downward. A first engaging pawl 834 that projects to the right is provided on the right side of the lower end of the first vent plug protruding portion 83. The second vent plug protruding portion 85 is provided on the left side of the vent plug 7. The second vent plug protruding portion 85 is formed by a plate-shaped member and deforms elastically rightward toward the vent plug 7. The second vent plug protruding portion 85 extends downward from the left side of the vent plug 7, then bends at its lowest point and extends upward. A second engaging pawl 856 that projects to the left is provided on the left side face of the second vent plug protruding portion 85.

The insertion portion 76 is provided in the rear end portion of the vent plug 7. The insertion portion 76 has a cylindrical shape that extends from the front to the rear. The insertion portion 76 is disposed between the two sheets 13A, 13B and inserted into the interior of the liquid-holding portion 133. The sheets 13A, 13B are thermally welded to the insertion portion 76.

As shown in FIGS. 2 and 3, the overall appearance of the case 32 is a box shape, with its long axis extending from the front to the rear. The case 32 is provided with a first case 33, a second case 60, a shaft portion 43, an elastic member 45, a detection portion 46 (refer to FIG. 12), a switching member 205 (refer to FIG. 6), and the like. The first case 33 supports the liquid-holding container 31. The second case 60 is disposed on the upper side of the first case 33. The second case 60 is configured to slide toward the front and the rear in relation to the first case 33.

Figure 6:
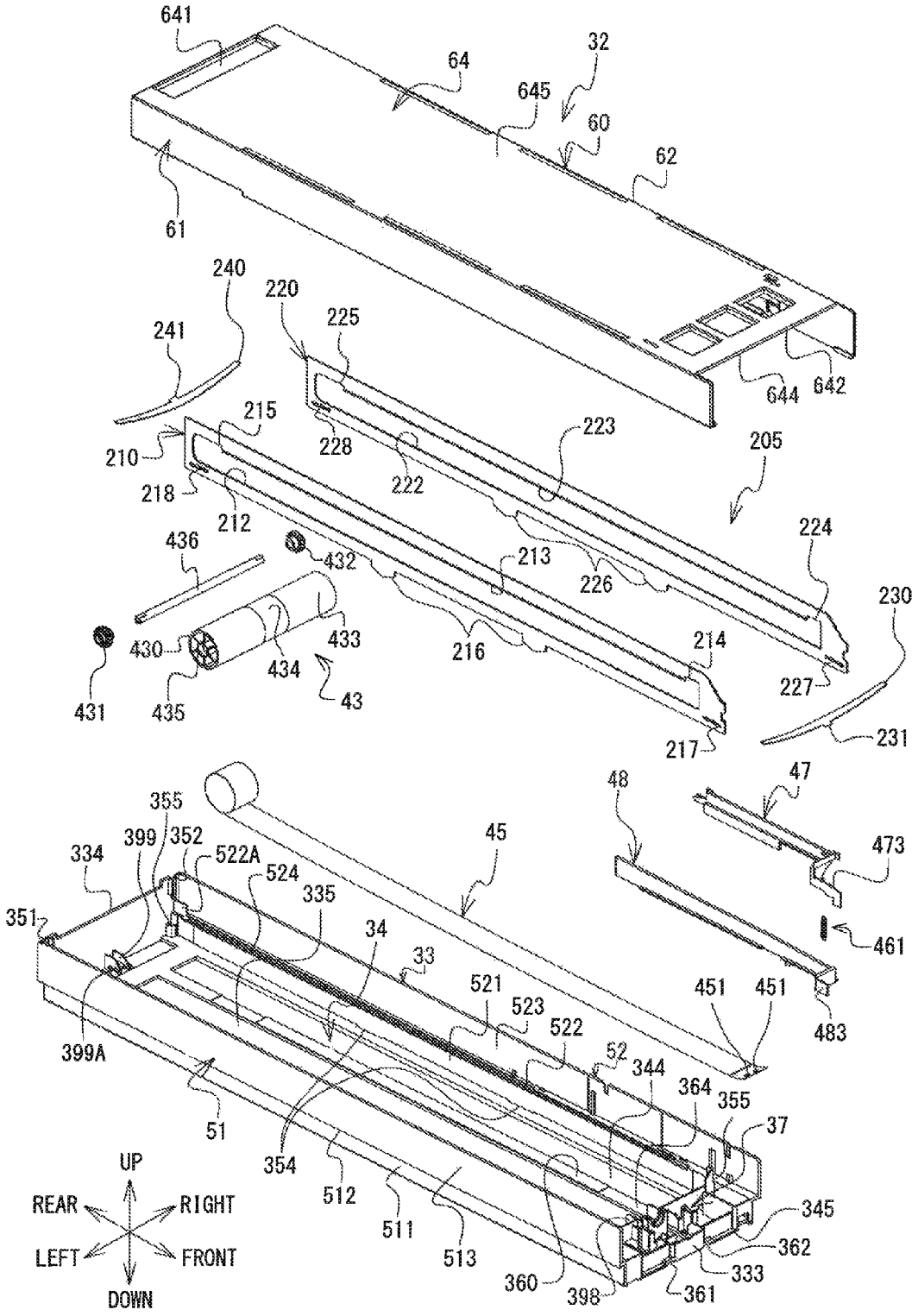
FIG. 6 is an oblique exploded view of a case.

As shown in FIG. 6, the first case 33 is provided with a supporting wall portion 34, a vent plug support portion 37, a pair of side walls 51, 52, a front wall portion 333, a rear wall portion 334, and the like. The supporting wall portion 34 is a wall portion that extends in the front-rear direction and the left-right direction, and it is rectangular, with its long axis extending from the front to the rear. The top face and the bottom face of the supporting wall portion 34 will respectively be called the first inner face 344 and the first outer face 345. The pair of the side walls 51, 52 are respectively side walls on the left and right sides of the first case 33, and they extend upward from the left side and the right side of the supporting wall portion 34. The rear wall portion 334 is a side wall on the rear side of the first case 33, and it extends upward along the rear side of the supporting wall portion 34. Slits 351, 352 are respectively provided on the left end and right end of the rear wall portion 334 and extend downward from the top edge of the rear wall portion 334.

As shown in FIGS. 6 and 9, the side wall 51 on the left side is provided with a first section 511, a second section 512, a third section 513, and a lower support portion 514. The first section 511 is a wall portion that extends upward from the left side of the first inner face 344 and constitutes a lower side part of the side wall 51. The second section 512 is a section that projects to the left from the top edge of the first section 511. The third section 513 is a wall portion that extends upward from the left edge of the second section 512 and constitutes an upper side part of the side wall 51. A restricting wall 512A (refer to FIG. 13B) is a wall portion that is provided on the rear end of the second section 512 and projects upward from the second section 512.

The side wall 52 on the right side is provided with a first section 521, a second section 522, a third section 523, and a lower support portion 524. The first section 521 is a wall portion that extends upward from the right side of the first inner face 344 and constitutes a lower side part of the side wall 52. The second section 522 is a section that projects to the right from the top edge of the first section 521. The third section 523 is a wall portion that extends upward from the right edge of the second section 522 and constitutes an upper side part of the side wall 52. A restricting wall 522A is a wall portion that is provided on the rear end of the second section 522 and projects upward from the second section 522.

The lower support portions 514, 524 are provided symmetrically on the left and right sides, respectively, and are rack gears on which pluralities of teeth that are disposed facing upward are arrayed continuously in the front-rear direction. The lower support portion 514 is provided with the second section 512 on its right edge. The lower support portion 524 is provided with the second section 522 on its left edge (refer to FIG. 7). The lower support portions 514, 524 each extend from slightly in front of the rear wall portion 334 to slightly to the rear of the vent plug support portion 37.

Figure 7:
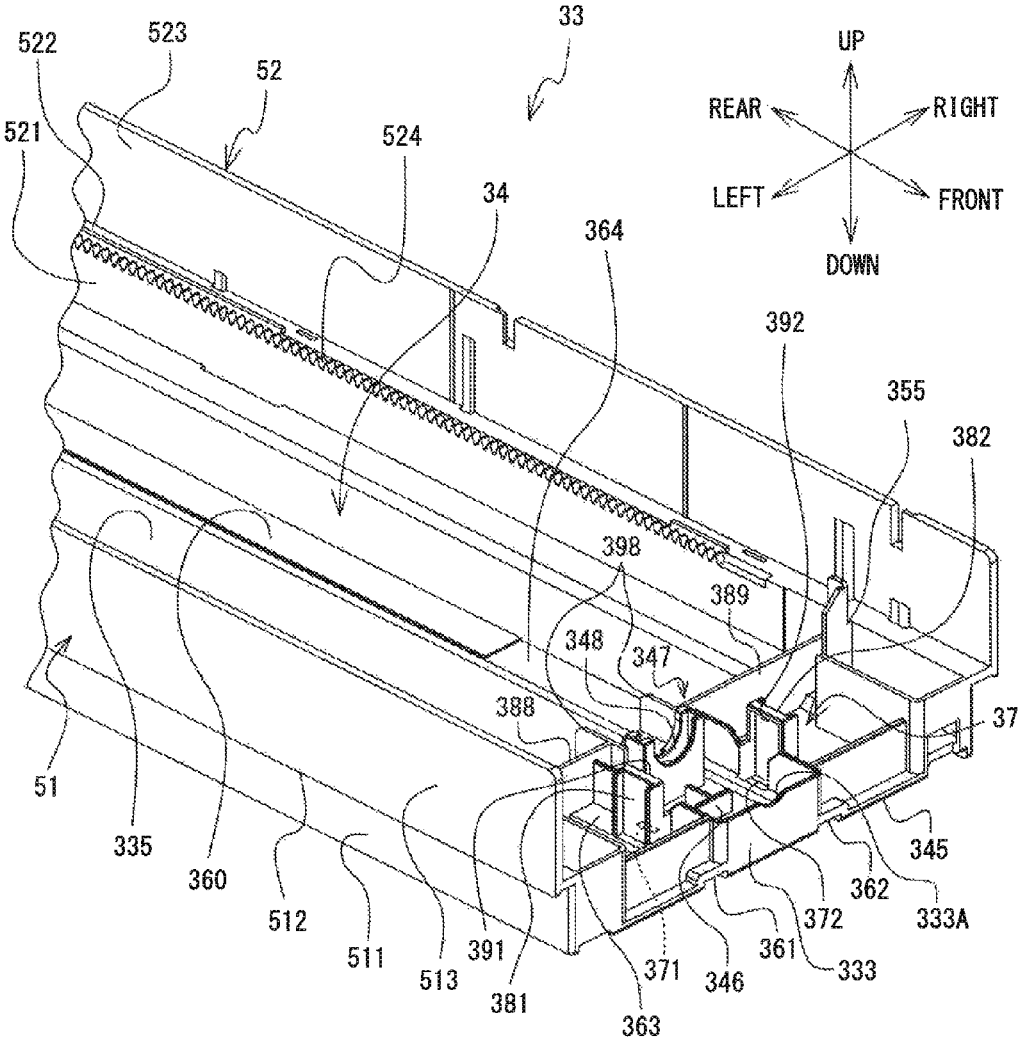
FIG. 7 is an oblique view of the front end of a first case.
Figure 8:
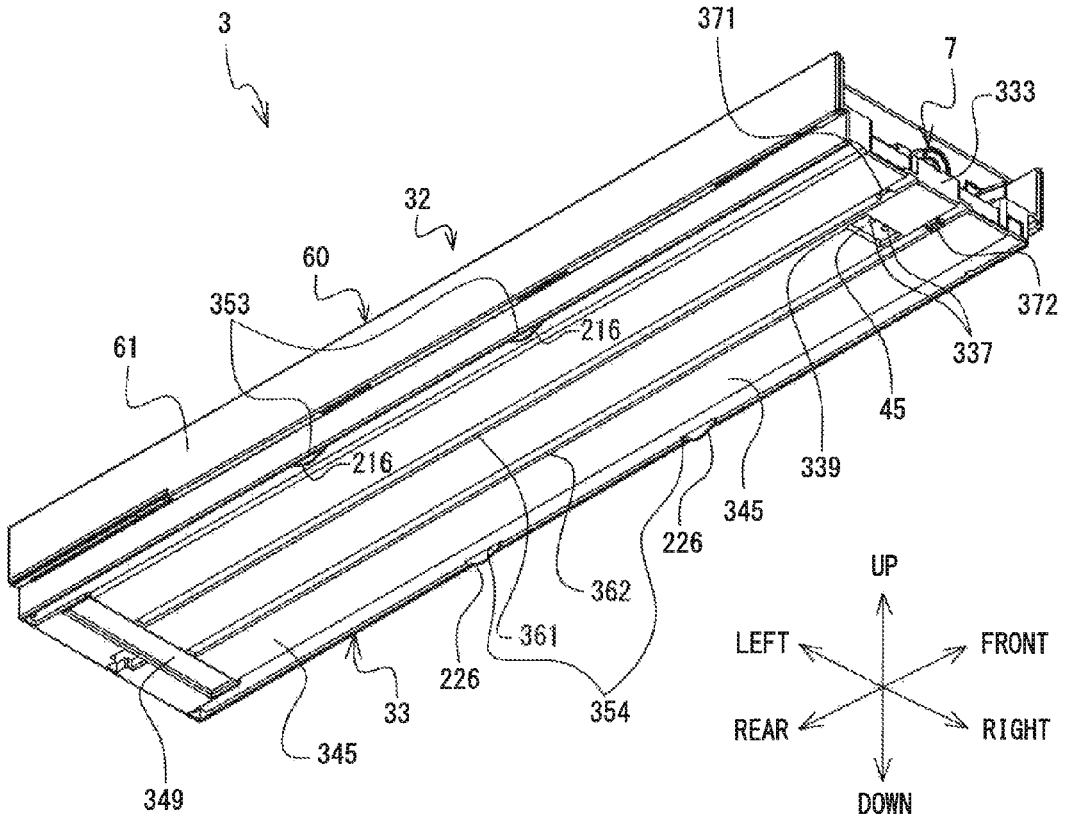
FIG. 8 is an oblique view of the cartridge from below, in which the second case is in the closed position.

As shown in FIGS. 7 and 8, the front wall portion 333, which is rectangular in a front view, is provided on the front end of the supporting wall portion 34. The front wall portion 333 extends upward from the center in the left-right direction of the front end of the first inner face 344 to a position at approximately the same height as the upper edges of the first sections 511, 521. A recessed portion 333A is formed in the center in the left-right direction of the front wall portion 333 and is a portion that is recessed downward in a circular arc shape from the upper edge of the front wall portion 333.

Two grooves 361, 362 that are recessed upward are formed in the first outer face 345. The groove 361 is provided in the left side of the front wall portion 333 and extends from the front edge of the supporting wall portion 34 to a point that is slightly in front of the rear edge of the supporting wall portion 34. The groove 362 is provided in the right side of the front wall portion 333 and extends from the front edge of the supporting wall portion 34 to a point that is slightly in front of the rear edge of the supporting wall portion 34. Projecting portions 363, 364 are located on the upper side of the grooves 361, 362 in the first inner face 344, extending in the front-rear direction while projecting upward (refer to FIG. 9). Anti-slip members 360, which are plate-shaped pieces of rubber, are affixed to the top faces of the projecting portions 363, 364, but they will be described in detail later.

As shown in FIG. 7, the vent plug support portion 37 is a component that is provided on the front end of the supporting wall portion 34 and that is configured to support the vent plug 7. The vent plug support portion 37 is provided with first openings 371, 372, second openings 391, 392, opening wall portions 381, 382, a first support portion 346, and a second support portion 347. The first support portion 346 is provided to the rear of the front wall portion 333. The first support portion 346 is a plate-shaped member that is T-shaped in a plan view and projects upward from the first inner face 344. In a front view, the first support portion 346 is slightly lower than the recessed portion 333A. The second support portion 347 is provided to the rear of the first support portion 346, between the two grooves 361, 362. The second support portion 347 is a wall portion that projects upward from the supporting wall portion 34 and extends in the left-right direction. A recessed portion 348 that, in a front view, is recessed downward from the upper edge of the second support portion 347 in a substantially circular arc shape is provided in the second support portion 347. In a front view, the recessed portion 348 is slightly higher than the recessed portion 333A.

The first openings 371, 372 are rectangular openings in a plan view and are respectively provided on the left and right sides of the first support portion 346. The first opening 371 is provided in the groove 361 and the projecting portion 363 and extends through the supporting wall portion 34 in the up-down direction. The first opening 372 is provided in the groove 362 and the projecting portion 364 and extends through the supporting wall portion 34 in the up-down direction. The opening wall portion 381 is a plate-shaped member that extends upward from the projecting portion 363 along the contour of the first opening 371 and covers the first opening 371 from above. The opening wall portion 381 includes the second opening 391, which is rectangular in a side view and is open on the right side. The first opening 371 and the second opening 391 are continuous with one another inside the opening wall portion 381. The opening wall portion 382 is a plate-shaped member that extends upward from the projecting portion 364 along the contour of the first opening 372 and covers the first opening 372 from above. The opening wall portion 382 includes the second opening 392, which is rectangular in a side view and is open on the left side. The first opening 372 and the second opening 392 are continuous with one another inside the opening wall portion 382.

A case recessed portion 335 is a recessed portion that is recessed downward between the projecting portions 363, 364. The case recessed portion 335 extends from the rear side of the vent plug support portion 37 to the front side of the rear end of the supporting wall portion 34. As shown in FIG. 8, a mounting opening 339 is provided in the case recessed portion 335 (refer to FIG. 7) on the rear side of the vent plug support portion 37. The mounting opening 339 is an opening that extends through the supporting wall portion 34 in the up-down direction. A mounting plate (not shown in the drawings) that is provided with two lugs 337 is provided slightly above the mounting opening 339. In a bottom view, the two lugs 337 are exposed through the mounting opening 339. The two lugs 337 project downward from the mounting plate (not shown in the drawings), on which they are arrayed in the left-right direction.

As shown in FIG. 8, an outer face recessed portion 349 is provided at the rear end of the first outer face 345. The outer face recessed portion 349 is a recessed portion that extends in the left-right direction in a bottom view. In a case where the operator removes the cartridge 3 through the opening 120 (refer to FIG. 1), the operator may easily pull the cartridge 3 out through the opening 120 by hooking a finger into the outer face recessed portion 349, for example.

As shown in FIGS. 6 and 8, two slits 353 are provided along the bottom edge of the right face of the first section 511. The two slits 353 are provided to the front and the rear of the center in the front-rear direction of the supporting wall portion 34. In the same manner, two slits 354 are provided along the bottom edge of the left face of the first section 521. The two slits 354 are provided such that they are symmetrical with the two slits 353 in the left-right direction. Each of the slits 353, 354 extends in the front-rear direction and passes through the supporting wall portion 34 in the up-down direction. The slits 353, 354 are configured to respectively support presser plates 210, 220, which will be described later, such that the presser plates 210, 220 are allowed to move up and down. It is sufficient for the slits 353, 354 respectively to be provided in accordance with spring positions of the support presser plates 210, 220, which will be described later.

As shown in FIGS. 6 and 7, anchor walls 388, 389 are respectively provided on the left and right sides of the second support portion 347. The anchor wall 388 extends upward from the first inner face 344 and extends to the left and the right between the second support portion 347 and the first section 511. The anchor wall 389 extends upward from the first inner face 344 and extends to the left and the right between the second support portion 347 and the first section 521. Holding portions 398 are provided on the anchor walls 388, 389. The holding portions 398 are a pair of plate-shaped bodies that extend toward the rear from the right end of the anchor wall 388 and the left end of the anchor wall 389. An energizing member 230, which will be described later, is affixed to the holding portions 398. Holding portions 399 are provided on the rear wall portion 334. The holding portions 399 are a pair of plate-shaped bodies that project toward the front from a central portion in the left-right direction of the rear wall portion 334. An energizing member 240, which will be described later, is affixed to the holding portions 399.

Slits 355 are provided in the upper part of the right edge of the anchor wall 389 and on the left side of the rear end of the first section 521. The slits 355 are configured to support the front and rear edges of the presser plate 220 such that the presser plate 220 is allowed to move up and down. Slits (not shown in the drawings) are also provided in the upper part of the left edge of the anchor wall 388 and on the right side of the rear end of the first section 511. The slits are configured to support the front and rear edges of the presser plate 210 such that the presser plate 210 is allowed to move up and down.

The switching member 205 will be explained. As shown in FIG. 6, the switching member 205 includes the presser plates 210, 220 and the energizing members 230, 240. The presser plate 210 is a frame-shaped plate that extends in the up-down direction and the front-rear direction. The height of the presser plate 210 is slightly less than the height of the side wall 51. The length of the presser plate 210 in the front-rear direction is approximately equal to the distance from the rear wall portion 334 to the anchor wall 388 (refer to FIG. 7). A slide opening 212, an upper support portion 213, retraction portions 214, 215, two foot portions 216, and anchor holes 217, 218 are provided in the presser plate 210.

The slide opening 212 is a substantially rectangular opening that is provided on the inner side of the presser plate 210 in a side view, and its long axis extends in the front-rear direction. The slide opening 212 extends through the presser plate 210 in the left-right direction and extends from the rear end to the front end of the presser plate 210. The upper edge and the lower edge of the slide opening 212 are substantially parallel. The upper support portion 213 is provided over the entire upper edge of the slide opening 212, except for the parts at the front end and the rear end.

The upper support portion 213 is a rack gear on which a plurality of teeth that are disposed facing downward are arrayed continuously in the front-rear direction. The distance from the lower edge of the slide opening 212 to the upper support portion 213 is slightly greater than the diameter of a rotary gear 431A (refer to FIG. 9), which will be described later. The retraction portions 214, 215 are respectively provided at the front and rear ends of the slide opening 212. The upper edge of the slide opening 212 in the retraction portions 214, 215 is higher than the upper support portion 213. The dimensions of the retraction portions 214, 215 in the up-down direction and the left-right direction are both slightly greater than the diameter of the rotary gear 431A. The rotary gear 431A is configured to move toward the front and the rear within the slide opening 212.

The two foot portions 216 are plate-shaped projections that project downward from positions to the front and the rear of the center in the front-rear direction of the presser plate 210. The two slits 353 (refer to FIG. 8) are provided in positions that correspond to the two foot portions 216. The two foot portions 216 are configured to be inserted into and removed from the two slits 353. The anchor holes 217, 218 are slits that extend in the front-rear direction. The anchor holes 217, 218 are provided in the lower edge of the presser plate 210 at the front and rear ends, respectively.

The presser plate 220 is a member that is identical to the presser plate 210, and it is provided with a slide opening 222, an upper support portion 223, retraction portions 224, 225, two foot portions 226, and anchor holes 227, 228. A rotary gear 432A (refer to FIG. 9), which will be described later, is configured to move toward the front and the rear within the slide opening 222. The two foot portions 226 are provided in positions that correspond to the two slits 354 (refer to FIG. 8) and configured to be inserted into and removed from the two slits 354.

The energizing members 230, 240 are members for attaching the presser plates 210, 220 to the first case 33. The energizing members 230, 240 are identical flat springs that extend approximately from left to right, and they are respectively attached to the holding portions 398, 399. An anchoring nub 231 that projects toward the front is provided in the center of the energizing member 230. An anchoring nub 241 that projects toward the rear is provided in the center of the energizing member 240.

As shown in FIGS. 6 and 9, the presser plate 210 is disposed along the right face of the first section 511, between the rear wall portion 334 and the anchor wall 388 (refer to FIG. 7). The two foot portions 216 are inserted into the corresponding two slits 353. The presser plate 220 is disposed along the left face of the first section 521, between the rear wall portion 334 and the anchor wall 389 (refer to FIG. 7). The two foot portions 226 are inserted into the corresponding two slits 354. The presser plates 210, 220 are thus disposed in a left-to-right array with the first sections 511, 521.

The anchoring nub 231 is anchored in the holding portion 398, thus positioning the energizing member 230 such that it does not shift to the left or the right. The holding portion 398 is provided with a hook (not shown in the drawings) that holds the energizing member 230 in place on the opposite side from the anchoring nub 231. The hook of the holding portion 398 positions the energizing member 230 such that it does not shift to the front or the rear. The ends of the energizing member 230 are inserted into the corresponding anchor holes 217, 227. The holding portion 398 holds the anchoring nub 231 lower than the anchor holes 217, 227. Accordingly, the energizing member 230 is held in a posture in which it curves upward toward both ends from the center in a front view. The elastic force of the energizing member 230 causes the ends of the energizing member 230 that have been inserted into the anchor holes 217, 227 to energize the presser plates 210, 220 downward.

In the same manner, the anchoring nub 241 is anchored in the holding portion 399, thus positioning the energizing member 240 such that it does not shift to the left or the right. The holding portion 399 is provided with a hook (not shown in the drawings) that holds the energizing member 240 in place on the opposite side from the anchoring nub 241. The hook of the holding portion 399 positions the energizing member 240 such that it does not shift to the front or the rear. The ends of the energizing member 240 are inserted into the corresponding anchor holes 218, 228. The holding portion 399 holds the anchoring nub 241 lower than the anchor holes 218, 228. Accordingly, the energizing member 240 is held in a posture in which it curves upward toward both ends from the center in a front view. The elastic force of the energizing member 240 causes the ends of the energizing member 240 that have been inserted into the anchor holes 218, 228 to energize the presser plates 210, 220 downward.

In this manner, the presser plates 210, 220 are held in a state of contact with the first inner face 344. The two foot portions 216 project below the first case 33 through the two slits 353. The two foot portions 226 project below the first case 33 through the two slits 354. When the foot portions 216, 226 are pressed from below, the presser plates 210, 220 are allowed to move upward against the elastic forces of the energizing members 230, 240.

The shaft portion 43 will be explained. As shown in FIGS. 6 and 9, the shaft portion 43 is provided with a shaft body 430, shaft support portions 431, 432, and a coupling shaft 436. The shaft body 430 is cylindrical and extends from left to right. The shaft body 430 is provided with an outer circumferential face 433, a shaft recessed portion 434, and a shaft hole 435. In the present embodiment, an anti-slip treatment has been performed on the outer circumferential face 433. Examples of an anti-slip treatment include covering the outer circumferential face 433 with resin sheet that prevents slipping, performing an anti-slip surface treatment, and making the shaft body 430 itself an elastic member (for example, rubber). It is also acceptable for an anti-slip treatment not to be performed on the outer circumferential face 433.

The shaft recessed portion 434 is provided in the center of the left-right direction of the outer circumferential face 433 and has a groove shape that is recessed slightly toward the inside of the shaft body 430 from the outer circumferential face 433. The shaft hole 435 is a hole that extends from left to right through the cross-sectional center (the center of rotation) of the shaft body 430. The coupling shaft 436 is inserted into the shaft hole 435. Both ends of the coupling shaft 436 that has been inserted into the shaft hole 435 protrude from the shaft hole 435 on the left and right sides. The shaft body 430 is configured to rotate around the coupling shaft 436 that has been inserted into the shaft hole 435.

The shaft support portions 431, 432 are members that are respectively provided on the left and right ends of the shaft body 430, and they are substantially coaxial with the center of rotation of the shaft body 430. The shaft support portion 431 is provided with the rotary gear 431A and a projecting portion 431B. The rotary gear 431A is a disc-shaped gear, around the circumference of which are formed a plurality of teeth that are configured to mesh with the lower support portion 514 and the upper support portion 213. The left end of the coupling shaft 436 is coupled and affixed to the center of rotation of the rotary gear 431A. The projecting portion 431B is a circular cylindrical body with a smaller diameter than that of the rotary gear 431A. The projecting portion 431B projects to the left from the center of rotation of the rotary gear 431A.

In the same manner, the shaft support portion 432 is provided with the rotary gear 432A and a projecting portion 432B. The rotary gear 432A is a disc-shaped gear, around the circumference of which are formed a plurality of teeth that are configured to mesh with the lower support portion 524 and the upper support portion 223. The right end of the coupling shaft 436 is coupled and affixed to the center of rotation of the rotary gear 432A. The projecting portion 432B is a circular cylindrical body with a smaller diameter than that of the rotary gear 432A. The projecting portion 432B projects to the right from the center of rotation of the rotary gear 432A.

The shaft support portion 431 has a coupling hole into which the left end of the coupling shaft 436 is inserted. The shaft support portion 432 has a coupling hole into which the right end of the coupling shaft 436 is inserted. Flat portions are formed on both ends of the coupling shaft 436. The coupling holes in the shaft support portions 431, 432 have cross-sectional shapes that correspond to the flat portions of the coupling shaft 436. Both ends of the coupling shaft 436 may be inserted into the coupling holes in the shaft support portions 431, 432 only when the rotary gears 431A, 432A are in phase with one another.

As shown in FIG. 9, the shaft body 430 is disposed inside the first case 33, between the presser plates 210, 220. The lower support portion 514 is exposed on the right side through the slide opening 212. The shaft support portion 431 is inserted into the slide opening 212 from the right side. The rotary gear 431A is disposed inside the slide opening 212 and meshes with the lower support portion 514. A rib 515 that extends in the front-rear direction is provided on the top face of the second section 512. The projecting portion 431B is disposed on the top side of the rib 515.

In the same manner, the lower support portion 524 is exposed on the left side through the slide opening 222. The shaft support portion 432 is inserted into the slide opening 222 from the left side. The rotary gear 432A is disposed inside the slide opening 222 and meshes with the lower support portion 524. A rib 525 that extends in the front-rear direction is provided on the top face of the second section 522. The projecting portion 432B is disposed on the top side of the rib 525.

The shaft portion 43 is thus supported from below by the ribs 515, 525 in a state in which the outer circumferential face 433 is slightly higher than the first inner face 344. Because the rotary gears 431A, 432A respectively mesh with the lower support portions 514, 524 in a state in which there is a small amount of backlash, they are allowed to rotate smoothly in conjunction with the movement of the shaft portion 43. A state in which there is backlash is a state in which gaps are provided between the rotary gears 431A, 432A and the lower support portions 514, 524, respectively. In that state, when the rotary gears 431A, 432A are engaged with the lower support portions 514, 524 and move, their movements are not hindered.

As shown in FIGS. 3 and 6, the elastic member 45 is a flat spring with one of a fixed load and a variable load that is disposed on the inner side of the case recessed portion 335. Two round holes 451 that are arrayed in the left-right direction are provided in the front end of the elastic member 45. The front end of the elastic member 45, which is disposed in the case recessed portion 335, is inserted from the rear into the gap between the mounting plate (not shown in the drawings) and the mounting opening 339. The front end of the elastic member 45 is anchored to the mounting plate by the engaging of the two lugs 337 in the two round holes 451 (refer to FIG. 8). The rear end of the elastic member 45, which extends toward the rear from the mounting plate, is wound around the shaft recessed portion 434 of the shaft portion 43. Because the elastic member 45 is energized such that a restorative force is generated toward the front, the elastic member 45 energizes the entire shaft portion 43 toward the front through the shaft body 430.

Figure 10:
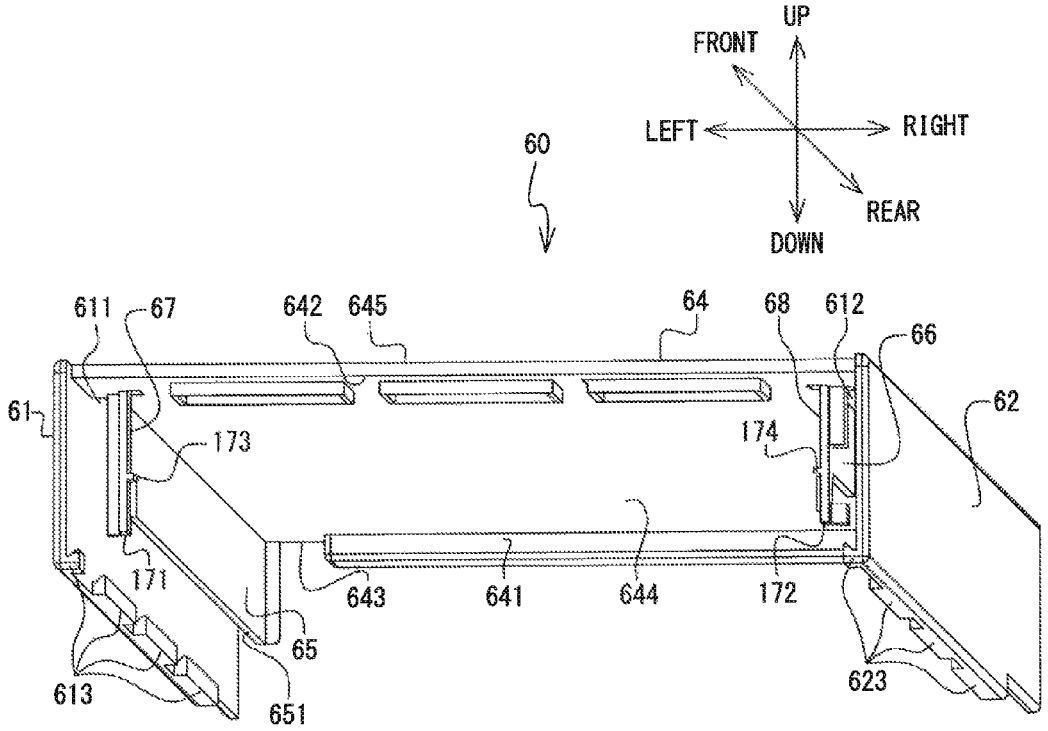
FIG. 10 is an oblique view of the second case.

As shown in FIGS. 6, 9, and 10, the second case 60 is provided with an upper wall portion 64, a pair of side walls 61, 62, first wall portions 65, 66, slots 611, 612, and second wall portions 67, 68. The upper wall portion 64 is a wall portion that extends in the front-rear direction and the left-right direction, and it is rectangular, with its long axis extending from the front to the rear. The top face and the bottom face of the upper wall portion 64 will respectively be called the second outer face 645 and the second inner face 644. An outer face recessed portion 641 that is recessed downward is provided at the rear end of the second outer face 645. In a plan view, the outer face recessed portion 641 is rectangular, with its long axis extending in the left-right direction. In a case where the operator slides the second case 60 in relation to the first case 33, the operator moves the second case 60 by inserting a finger into the outer face recessed portion 641, for example.

As shown in FIG. 10, an opening 642 that is open to the front is provided on the front end of the second case 60. An opening 643 that is open to the rear is provided on the rear end of the second case 60. The pair of the side walls 61, 62 are respectively side walls on the left and right sides of the second case 60, and they extend downward along the left side and the right side of the upper wall portion 64. Pluralities of terminal wall portions 613, 623 are provided on the bottom edges of the pair of the side walls 61, 62, respectively. The pluralities of the terminal wall portions 613, 623 project toward the inner side of the second case 60 from the bottom edges of the pair of the side walls 61, 62, respectively.

The first wall portion 65 is a wall portion that is provided on the right side of the side wall 61 and faces the side wall 61. The first wall portion 66 is a wall portion that is provided on the left side of the side wall 62 and faces the side wall 62. The first wall portions 65, 66 are positioned symmetrically on the left and right sides, respectively, of the liquid-holding bag 13 (refer to FIG. 12), and they extend downward from the second inner face 644. The first wall portions 65, 66 extend from the rear edge of the upper wall portion 64 to slightly to the rear of the front edge of the upper wall portion 64. The lower edges of the first wall portions 65, 66 are positioned higher than the pluralities of the terminal wall portions 613, 623.

The slot 611 is a slot that is formed between the first wall portion 65 and the side wall 61 and is recessed upward. The slot 612 is a slot that is formed between the first wall portion 66 and the side wall 62 and is recessed upward. The first wall portions 65, 66 are respectively connected to the second wall portions 67, 68, which are positioned symmetrically on the left and right sides, respectively, of the liquid-holding bag 13. The second wall portion 67 is a wall portion that extends toward the front from the right side of the front end of the first wall portion 65. The second wall portion 68 is a wall portion that extends toward the front from the left side of the front end of the first wall portion 66.

As shown in FIGS. 10 and 11, an operating portion 171 is provided on the bottom end of the front edge of the first wall portion 65. A bottom edge 651 of the first wall portion 65 extends in a straight line from the rear edge of the first wall portion 65 to the operating portion 171. The operating portion 171 projects downward below the bottom edge 651. In a side view, the rear edge of the operating portion 171 extends in a substantially circular arc toward the lower front from the front end of the bottom edge 651. The length of the operating portion 171 in the up-down direction is at least greater than the radius of the projecting portion 431B. A latch portion 173 is provided on the second wall portion 67. The latch portion 173 is a projecting portion that projects to the right from the right face of the second wall portion 67 and extends in the front-rear direction. The latch portion 173 is positioned higher than the bottom edge 651.

An operating portion 172 is provided on the first wall portion 66. The operating portions 171, 172 are positioned symmetrically on the left and right sides, respectively, of the liquid-holding bag 13. A latch portion 174 is provided on the second wall portion 68. The latch portions 173, 174 are positioned symmetrically on the left and right sides, respectively, of the liquid-holding bag 13.

As shown in FIGS. 9 and 10, in a case where the operator mounts the second case 60 on the first case 33, for example, the operator slides the second case 60 from the front side in relation to the first case 33. The second case 60 thus covers the first case 33 from above. Specifically, the pair of the side walls 61, 62 are disposed on the respective outer sides of the pair of the side walls 51, 52. The terminal wall portions 613, 623 engage with the second sections 512, 522. The third sections 513, 523 are disposed on the respective inner sides of the slots 611, 612. The first inner face 344 of the first case 33 and the second inner face 644 of the second case 60 face one another from below and above, respectively.

As shown in FIGS. 9 and 11, when the second case 60 is slid from the front side in relation to the first case 33, the latch portion 173 enters the retraction portion 214 of the presser plate 210, and the latch portion 174 enters the retraction portion 224 of the presser plate 220 (refer to FIG. 6). The latch portions 173, 174 are thus disposed inside the slide openings 212, 222. The left face of the presser plate 210 comes into contact with the second wall portion 67 on the upper side of the latch portion 173. The right face of the presser plate 220 comes into contact with the second wall portion 68 on the upper side of the latch portion 174. The projecting portion 431B is disposed below the bottom edge 651 and to the rear of the operating portion 171. The rotary gear 431A is disposed to the rear of the second wall portion 67 and on the right side of the first wall portion 65. The projecting portion 432B is disposed below the bottom edge of the first wall portion 66 and to the rear of the operating portion 172. The rotary gear 432A is disposed to the rear of the second wall portion 68 and on the left side of the first wall portion 66.

Figure 12:
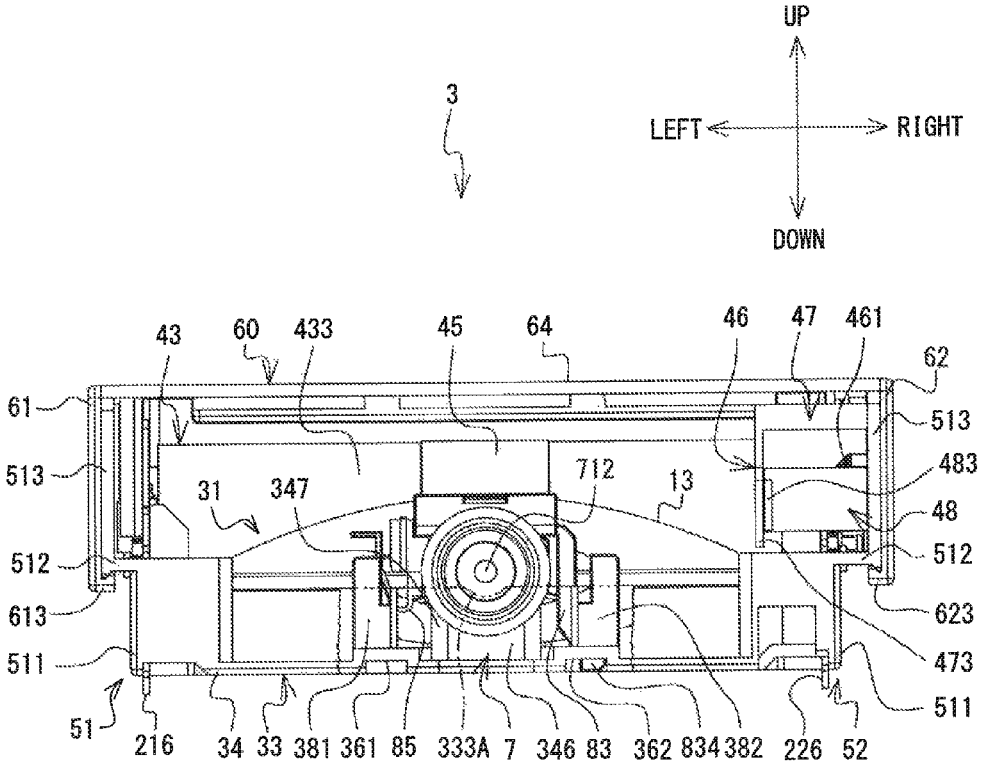
FIG. 12 is a front view of the cartridge.

As shown in FIGS. 6 and 12, the detection portion 46 is provided with a first side plate 47, a second side plate 48, and a coil spring 461. The first side plate 47 is provided with a first display portion 473 on its front edge. The second side plate 48 is provided with a second display portion 483 on its front edge. The coil spring 461 energizes the first side plate 47 and the second side plate 48 by engaging with the first side plate 47 and the second side plate 48.

As will be described later, the shaft portion 43 advances toward the front as it gathers the ink toward the vent plug 7 by rolling up the liquid-holding bag 13. The shaft portion 43 moves toward the front as the amount of the ink remaining in the liquid-holding bag 13 becomes smaller. As the shaft portion 43 moves forward, the projecting portion 432B (refer to FIG. 9) comes into contact with the first side plate 47 and the second side plate 48. This causes the positions of the first display portion 473 and the second display portion 483 in the up-down direction to move. The detection portion 46 uses the positions of the first display portion 473 and the second display portion 483 in the up-down direction to indicate the remaining amount of the ink.

Figure 13A:
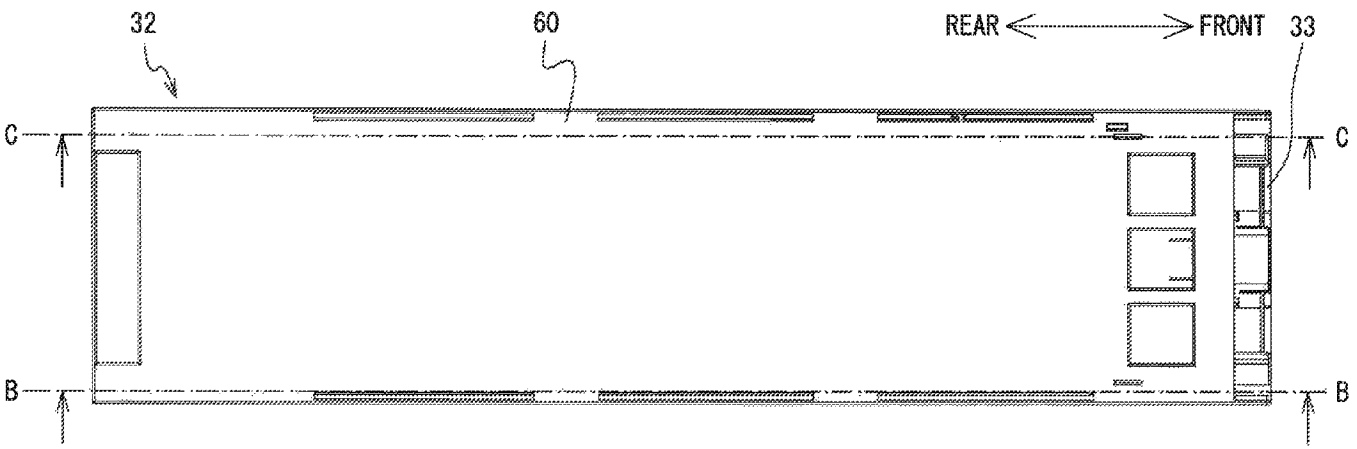
FIG. 13A is a plan view of the case, in which the second case is in the closed position.
Figure 13B:
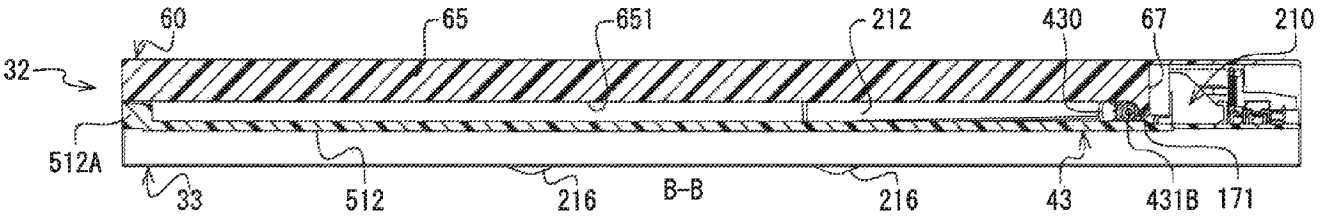
FIG. 13B is a section view from the direction of arrows on a line B-B in FIG. 13A.
Figure 13C:
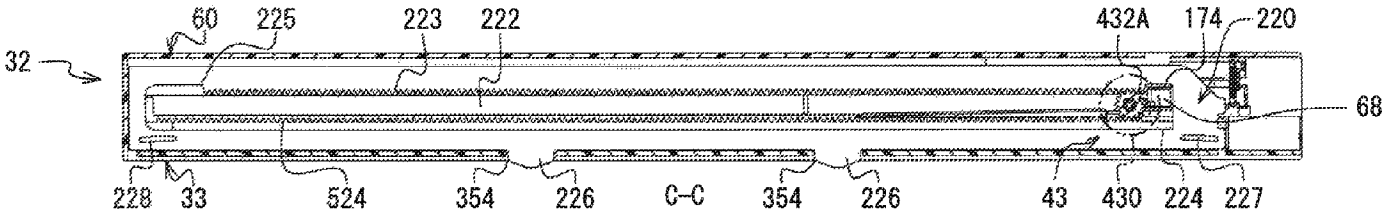
FIG. 13C is a section view from the direction of arrows on a line C-C in FIG. 13A.

The operation by which the operator mounts the liquid-holding container 31 in the case 32 will be explained. FIGS. 13A to 13C show a state in which the liquid-holding container 31 is not mounted in the case 32. FIGS. 14A to 14D, 15A to 15D, and 16A to 16D show states in which the liquid-holding container 31 is mounted in the case 32. In these drawings, the rotary gear 431A, the projecting portion 432B, the operating portion 172, the latch portion 173, the upper support portion 213, the retraction portions 214, 215, the slits 353, the second section 522, and the restricting wall 522A, none of which are shown in the drawings, and the rotary gear 432A, the projecting portion 431B, the operating portion 171, the latch portion 174, the upper support portion 223, the retraction portions 224, 225, the slits 354, the second section 512, and the restricting wall 512A, all of which are shown in the drawings, are respectively provided symmetrically on the left and right sides of the liquid-holding bag 13. In FIG. 13C, the shaft body 430 is indicated by a virtual line in a side view.

In the example that is shown in FIGS. 13A to 13C, the liquid-holding container 31 is not mounted in the case 32, and the second case 60 is in a closed position. As shown in FIG. 13A, the closed position is a position in which the second case 60 covers substantially the entire first case 33 from above. As shown in FIGS. 13B and 13C, in a side view, the second wall portions 67, 68 are positioned slightly to the rear of the holding portion 398 (refer to FIG. 6). The latch portions 173, 174 are respectively disposed inside the retraction portions 214, 224. The operating portions 171, 172 are respectively disposed slightly to the rear of the retraction portions 214, 224 in a side view.

As shown in FIG. 13B, the shaft portion 43 is moved by the elastic force of the elastic member 45 (refer to FIG. 6) to a first movable position, which is at the front end of the range of movement of the shaft portion 43. The first movable position is a position where the projecting portions 431B, 432B of the shaft portion 43 respectively come into contact from the rear with the operating portions 171, 172 of the second case 60, which is in the closed position. When the shaft portion 43 is in the first movable position, its movement toward the front is restricted by the operating portions 171, 172, which are in contact with the projecting portions 431B, 432B. The rotary gears 431A, 432A are respectively positioned to the rear of the retraction portions 214, 224 and mesh with the lower support portions 514, 524.

As shown in FIG. 13C, the case 32 is not placed on a flat surface (for example, on a table), so the foot portions 216, 226 project below the first case 33. The presser plates 210, 220 are held in lowered positions by the energizing forces of the energizing members 230, 240 (refer to FIG. 6). The lowered positions are positions in which the presser plates 210, 220 are in contact with the first inner face 344 (refer to FIG. 6) from above. In a case where the latch portions 173, 174 are respectively in the retraction portions 214, 224, or in the retraction portions 215, 225, the presser plates 210, 220 are allowed to move to the lowered positions.

In a case where the presser plate 210 is in the lowered position, the latch portion 173 is disposed within the slide opening 212 higher than the upper support portion 213, and the upper support portion 213 is disposed lower than the upper edge of the rotary gear 431A. In the same manner, the latch portion 174 is disposed within the slide opening 222 higher than the upper support portion 223, and the upper support portion 223 is disposed lower than the upper edge of the rotary gear 432A. In the example that is shown in FIG. 13C, the front ends of the upper support portions 213, 223 respectively mesh with the upper sides of the rotary gears 431A, 432A to the rear of the retraction portions 214, 224, but that operation will be described later.

In the example that is shown in FIG. 13C, the latch portion 173 is disposed inside the retraction portion 214 and is bounded by the retraction portion 214 on the front and the rear. The latch portion 174 is disposed inside the retraction portion 224 and is bounded by the retraction portion 224 on the front and the rear. In this state, in a case where an external force is applied that energizes the second case 60 toward the rear, the latch portions 173, 174 come into contact with the edges of the retraction portions 214, 224 from the front (refer to FIG. 11). The movements of the latch portions 173, 174 toward the rear are restricted, so the movement of the second case 60 toward the rear in relation to the first case 33 is restricted.

First, the operator places the case 32 that is shown in FIGS. 13A to 13C on a flat surface. In the present embodiment, the energizing forces by which the energizing members 230, 240 energize the presser plates 210, 220 downward are, at their greatest, less than the weight of the case 32. Accordingly, when the foot portions 216, 226 come into contact with the flat surface on which the case 32 has been placed, they move upward against the elastic forces of the energizing members 230, 240 and enter the interior of the first case 33.

The presser plates 210, 220 thus move into raised positions from the lowered positions. The raised positions are positions in which the presser plates 210, 220 have been moved upward away from the first inner face 344 (refer to FIGS. 15B, 15C). In a case where the presser plate 210 is in the raised position, the latch portion 173 is disposed within the slide opening 212 lower than the upper support portion 213, and the upper support portion 213 is disposed higher than the upper edge of the rotary gear 431A. In a case where the presser plate 220 is in the raised position, the latch portion 174 is disposed within the slide opening 222 lower than the upper support portion 223, and the upper support portion 223 is disposed higher than the upper edge of the rotary gear 432A.

In a state in which the presser plates 210, 220 are in the raised positions, the operator slides the second case 60 toward the rear in relation to the first case 33. At this time, within the slide opening 212, the latch portion 173 passes slightly below the upper support portion 213 and moves toward the rear from the retraction portion 214. In the same manner, within the slide opening 222, the latch portion 174 passes slightly below the upper support portion 223 and moves toward the rear from the retraction portion 224 (refer to FIG. 15C). In other words, in a case where the presser plates 210, 220 are in the raised positions, the restriction on the rearward movement of the second case 60 is removed.

The operating portions 171, 172 move toward the rear in coordination with the second case 60 and respectively press the projecting portions 431B, 432B toward the rear. The projecting portion 431B passes above the second section 512 and moves toward the rear. In the same manner, the projecting portion 432B passes above the second section 522 and moves toward the rear. The rotary gears 431A, 432A thus move toward the rear while rotating in states of meshing with the lower support portions 514, 524, respectively. The rotary gears 431A, 432A move by passing below the upper support portions 213, 223, respectively, so they do not interfere with the upper support portions 213, 223. The shaft body 430 also moves toward the rear in conjunction with the rearward movement of the rotary gears 431A, 432A. At this time, the shaft body 430 moves toward the rear while being rotated by the energizing force of the elastic member 45.

In a case where the second case 60 slides toward the front and the rear between the closed position and an open position that will be described later, the first wall portions 65, 66 of the second case 60 (refer to FIG. 10) respectively pass along the inner sides of the slits 351, 352 of the first case 33 (refer to FIG. 6).

Figures 14A, 14B, 14C, 14D:
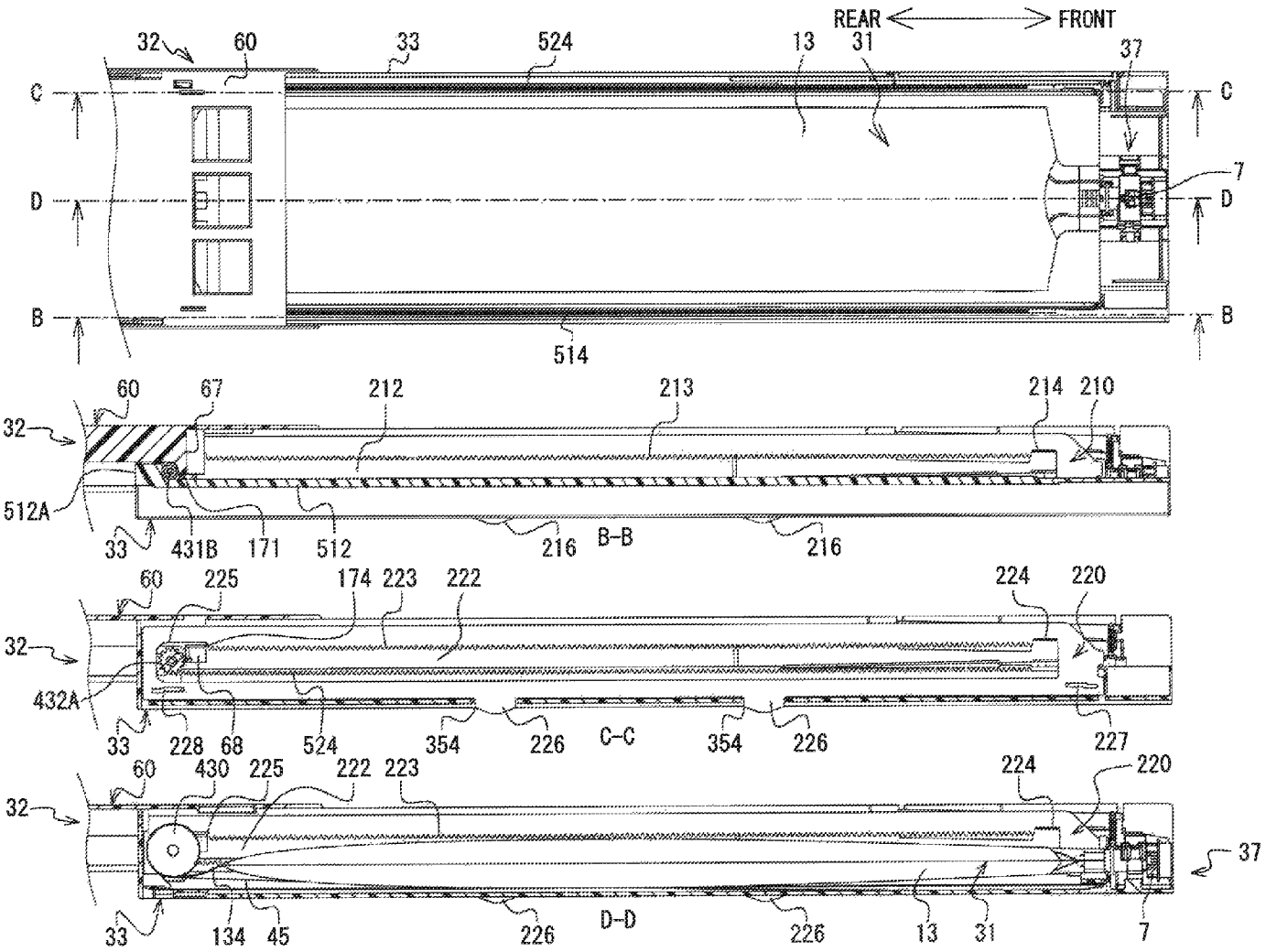
FIG. 14A is a plan view of the case, in which the second case is in the open position.
FIG. 14B is a section view from the direction of arrows on a line B-B in FIG. 14A.
FIG. 14C is a section view from the direction of arrows on a line C-C in FIG. 14A.
FIG. 14D is a section view from the direction of arrows on a line D-D in FIG. 14A.

As shown in FIG. 14A, the operator moves the second case 60 toward the rear as far as the open position. As shown in FIGS. 14B and 14C, in a case where the second case 60 is in the open position, the second wall portions 67, 68 are disposed slightly to the front of the holding portion 399 (refer to FIG. 6) in a side view. The latch portions 173, 174 are disposed inside the retraction portions 215, 225, respectively. In a side view, the operating portions 171, 172 are respectively disposed slightly in front of the restricting walls 512A, 522A.

As shown in FIGS. 14B and 14D, the shaft portion 43 (refer to FIG. 7) moves against the energizing force of the elastic member 45 to a second movable position, which is at the rear end of the range of movement of the shaft portion 43. The second movable position is a position where the projecting portions 431B, 432B, which are respectively pressed from the front by the operating portions 171, 172, respectively come into contact with the front ends of the restricting walls 512A, 522A of the first case 33. When the shaft portion 43 is in the second movable position, its movement toward the rear is restricted by the restricting walls 512A, 522A, which are in contact with the projecting portions 431B, 432B. The rotary gears 431A, 432A are respectively positioned inside the retraction portions 215, 225 and mesh with the lower support portions 514, 524.

As shown in FIG. 14, after moving the second case 60 to the open position, the operator lifts the case 32 up from the flat surface (for example, the table). The projecting of the foot portions 216, 226 below the first case 33 moves the presser plates 210, 220 to the lowered positions. In the example that is shown in FIG. 14C, the latch portion 173 is disposed inside the retraction portion 215 and is bounded by the retraction portion 215 on the front and the rear. The latch portion 174 is disposed inside the retraction portion 225 and is bounded by the retraction portion 225 on the front and the rear. In this state, in a case where an external force is applied that energizes the second case 60 toward the front, the latch portions 173, 174 come into contact with the edges of the retraction portions 215, 225 from the rear. The movements of the latch portions 173, 174 toward the front are restricted, so the movement of the second case 60 toward the front in relation to the first case 33 is restricted.

Next, the operator stows the liquid-holding container 31 in the first case 33, as shown in FIG. 14. Specifically, the operator disposes the liquid-holding bag 13 in the first case 33 to the rear of the vent plug support portion 37, as shown in FIGS. 7 and 12. The operator disposes the vent plug 7 on the first support portion 346 and the second support portion 347 from above, while elastically deforming the second vent plug protruding portion 85 toward the vent plug 7. At this time, the operator inserts the first vent plug protruding portion 83 into the first opening 372 and engages the first engaging pawl 834 with the groove 362. The operator engages the second engaging pawl 856 of the elastically deformed second vent plug protruding portion 85 (refer to FIG. 5) with the second opening 391. The vent plug 7 is thus supported by the vent plug support portion 37. The sheet 13B of the liquid-holding bag 13 (refer to FIG. 5) is placed on the first inner face 344 and comes into contact with the two anti-slip members 360, which are disposed on the left and the right.

The first openings 371, 372 are provided symmetrically on the left and right sides, respectively, of the first support portion 346. The second openings 391, 392 are also provided symmetrically on the left and right sides, respectively, of the first support portion 346. In a case where, for example, the first vent plug protruding portion 83 is disposed on the left side of the first support portion 346 and the second vent plug protruding portion 85 is disposed on the right side of the first support portion 346, the first engaging pawl 834 of the first vent plug protruding portion 83 engages with the first opening 371, and the second engaging pawl 856 of the second vent plug protruding portion 85 engages with the second opening 392.

Figures 15A, 15B, 15C, 15D:
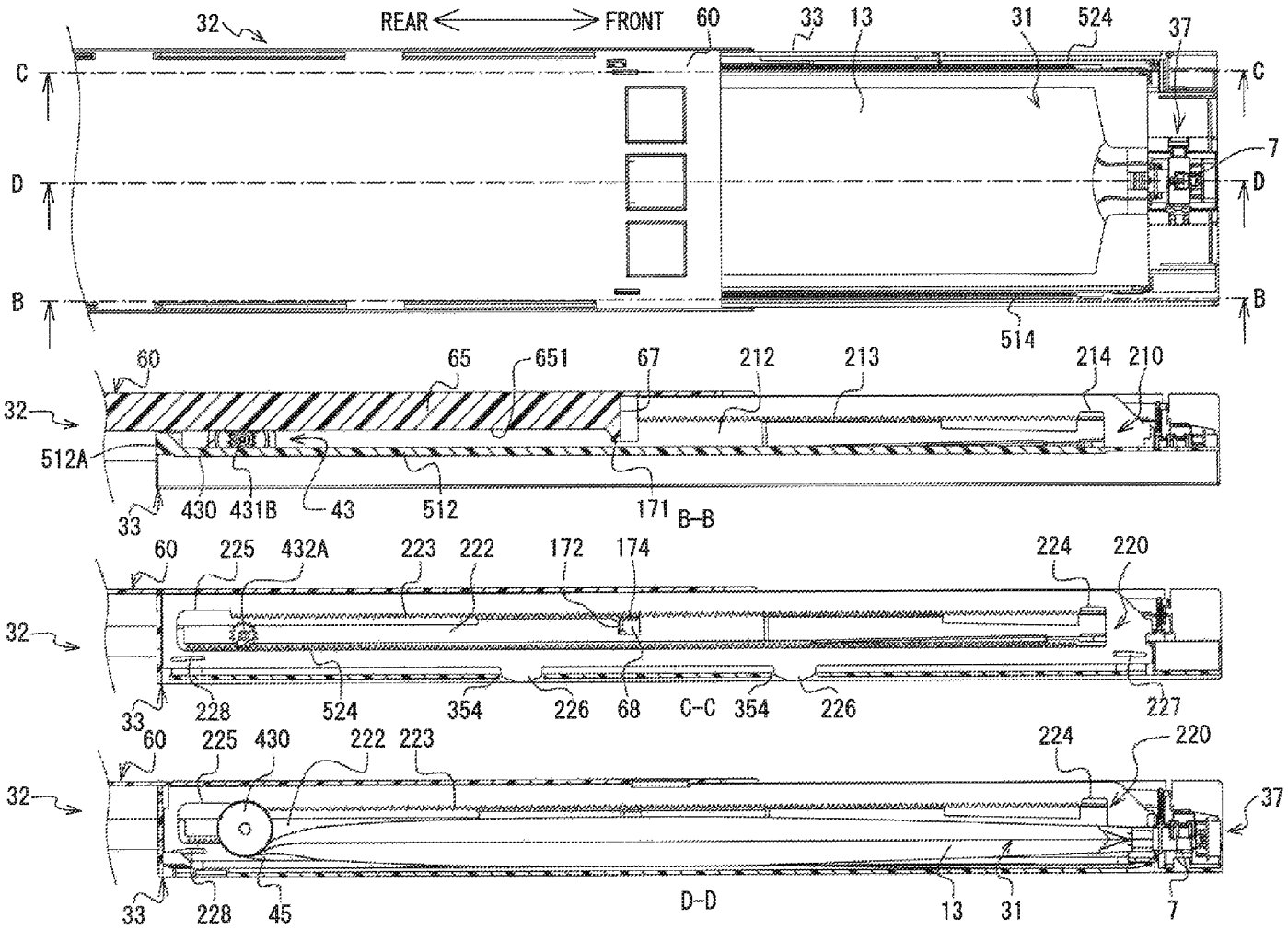
FIG. 15A is a plan view of the case, in which the second case is between the closed position and the open position.
FIG. 15B is a section view from the direction of arrows on a line B-B in FIG. 15A.
FIG. 15C is a section view from the direction of arrows on a line C-C in FIG. 15A.
FIG. 15D is a section view from the direction of arrows on a line D-D in FIG. 15A.

Next, the operator places the case 32 that is shown in FIG. 14 on a flat surface. In the same manner as previously described, the presser plates 210, 220 move from the lowered positions to the raised positions. With the presser plates 210, 220 in the raised positions, the operator slides the second case 60 toward the front in relation to the first case 33, as shown in FIG. 15A. Within the slide opening 212, the latch portion 173 passes slightly below the upper support portion 213 and moves toward the front from the retraction portion 215, as shown in FIG. 15C. In the same manner, within the slide opening 222, the latch portion 174 passes slightly below the upper support portion 223 and moves toward the front from the retraction portion 225. In other words, in a case where the presser plates 210, 220 are in the raised positions, the restriction on the forward movement of the second case 60 is removed.

As shown in FIGS. 15B and 15D, the operating portions 171, 172 move toward the front in coordination with the second case 60. In conjunction with this, the shaft body 430, under the energizing force of the elastic member 45, is moved toward the front from the second movable position while rotating. The projecting portion 431B thus passes above the second section 512 and moves toward the front. In the same manner, the projecting portion 432B passes above the second section 522 and moves toward the front. As shown in FIG. 15C, the rotary gears 431A, 432A move toward the front while rotating in states of meshing with the lower support portions 514, 524, respectively. At this time, the rotary gears 431A, 432A move by passing below the upper support portions 213, 223, respectively, so they do not interfere with the upper support portions 213, 223.

As shown in FIG. 15D, the shaft body 430, when it moves toward the front from the second movable position while rotating, rolls up the liquid-holding bag 13 toward the front, starting from the rear end portion 132 (refer to FIG. 4). After rolling up the extension portion 134, in which the ink is not disposed, the shaft body 430 rolls up the liquid-holding portion 133 from the rear. The ink inside the liquid-holding portion 133 is pushed forward toward the vent plug 7 as the liquid-holding portion 133 is rolled up. The shaft portion 43 stops at a position where the energizing force of the elastic member 45 and the rebound force of the liquid-holding portion 133 become equal.

As shown in FIG. 15C, when the second case 60 is between the closed position and the open position, the latch portions 173, 174 are respectively disposed directly below the upper support portions 213, 223. In a case where the case 32 is separated from the flat surface in this state, the presser plates 210, 220 move downward from the raised positions and are supported from below by the latch portions 173, 174, respectively. The latch portions 173, 174 respectively support the upper support portions 213, 223 in positions that are respectively higher than the rotary gears 431A, 432A. In other words, in a state in which the second case 60 is between the closed position and the open position, the upper support portions 213, 223 do not interfere with the rotary gears 431A, 432A, so the shaft portion 43 is allowed to move toward the front and the rear.

If the movement of the shaft portion 43 were to be restricted while the second case 60 is sliding, the projecting portions 431B, 432B of the shaft portion 43 might engage with the operating portions 171, 172 of the second case 60 and impede the sliding movement of the second case 60. As explained above, the movement of the shaft portion 43 is not restricted while the second case 60 is sliding, so there is less concern that the sliding movement of the second case 60 will be impeded.

Figures 16A, 16B, 16C, 16D:
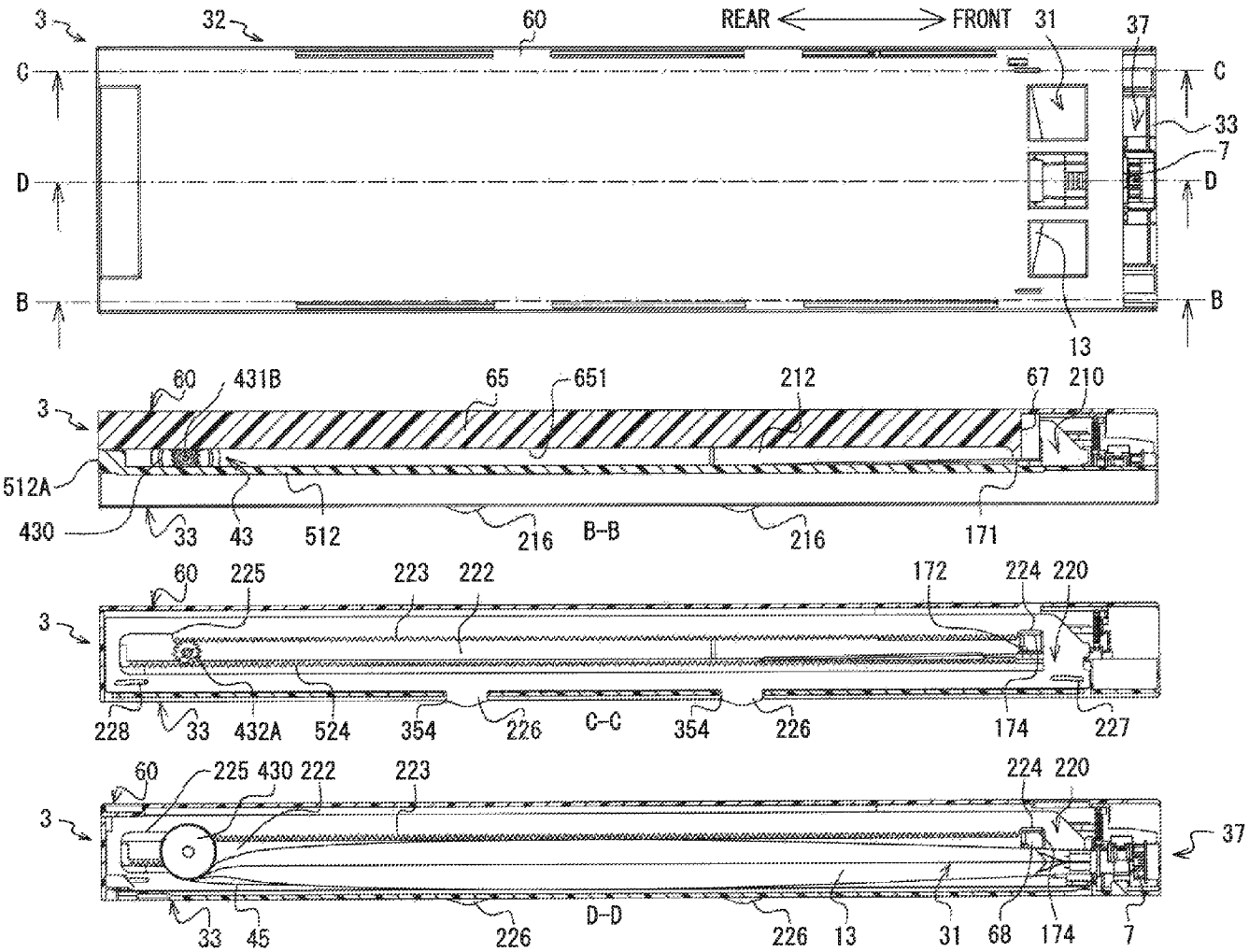
FIG. 16A is a plan view of the case, in which the second case is in the closed position.
FIG. 16B is a section view from the direction of arrows on a line B-B in FIG. 16A.
FIG. 16C is a section view from the direction of arrows on a line C-C in FIG. 16A.
FIG. 16D is a section view from the direction of arrows on a line D-D in FIG. 16A.

The operator moves the second case 60 forward to the closed position, as shown in FIG. 16A. As shown in FIGS. 16B and 16C, the second wall portions 67, 68 are disposed slightly to the rear of the holding portion 398 (refer to FIG. 6). The latch portions 173, 174 are disposed inside the retraction portions 214, 224, respectively. In a side view, the operating portions 171, 172 are disposed slightly to the rear of the retraction portions 214, 224, respectively. The cartridge 3 in which the liquid-holding container 31 is mounted in the case 32 is thus complete.

Thereafter, the operator lifts the cartridge 3 up from the flat surface. The presser plates 210, 220 move from the raised positions to the lowered positions. As shown in FIG. 16C, the latch portion 173 is disposed inside the retraction portion 214 and is bounded by the retraction portion 214 on the front and the rear. The latch portion 174 is disposed inside the retraction portion 224 and is bounded by the retraction portion 224 on the front and the rear. Thus, in the same manner as described previously, the sliding movement of the second case 60 is restricted in relation to the first case 33.

Furthermore, as shown in FIG. 16C, the upper support portions 213, 223 mesh with the rotary gears 431A, 432A, respectively. In other words, the upper support portion 213 and the lower support portion 514 hold the rotary gear 431A between them from above and below, respectively. The upper support portion 223 and the lower support portion 524 hold the rotary gear 432A between them from above and below, respectively. The rotating of the rotary gears 431A, 432A (that is, the movement of the shaft portion 43 toward the front and the rear) is thus restricted.

A case may occur in which, for example, an external force that is applied to the case 32 (vibration or the like of the case 32) acts so as to move the shaft portion 43. Cases also occur in which the rebound force of the ink with which the liquid-holding portion 133 is filled acts so as to move the shaft portion 43. Even in these sorts of cases, the movement of the shaft portion 43 is restricted by the structure that is described above. The rotary gears 431A, 432A also mesh with the lower support portions 514, 524, which are rack gears, such that the rotary gears 431A, 432A rotate in phase with one another. Therefore, even in a case where an external force that is applied to the case 32 acts on the shaft portion 43, the axial direction of the shaft portion 43 (the direction in which the coupling shaft 436 extends) is inhibited from deviating from the proper axial direction (in the present embodiment, the left-right direction).

As described above, when the completed cartridge 3 is separated from the table, the cartridge 3 is naturally prevented from opening, and the movement of the shaft portion 43 is restricted. Therefore, the operator may carry the cartridge 3 in a stable manner. Assume, for example, that the operator shakes the cartridge 3 before mounting it in the cartridge mounting portion 8. In that case, the ink inside the liquid-holding portion 133 is agitated, while the sliding movement of the second case 60 and the movement of the shaft portion 43 are prevented.

Thereafter, the operator mounts the cartridge 3 in the cartridge mounting portion 8 (refer to FIG. 1) by inserting the cartridge 3 into the opening 120 starting from the front end of the cartridge 3. When the cartridge 3 comes into contact with the interior bottom face of the cartridge mounting portion 8, the presser plates 210, 220 move from the lowered positions to the raised positions. The restriction on the movement of the shaft portion 43 is removed. As described previously, the hollow needle (not shown in the drawings) for drawing the liquid out of the liquid-holding container 31, which is contained in the cartridge 3, pierces the rubber plug (not shown in the drawings) that is disposed in the vent plug 7 of the liquid-holding container 31. If the front wall portion 333 were to be made higher, the hollow needle might come into contact with the front wall portion 333 before it pierces the rubber plug. In the present embodiment, contact between the hollow needle and the front wall portion 333 is inhibited by the recessed portion 333A that is formed in the front wall portion 333. The front wall portion 333 inhibits any ink that leaks from the rubber plug after it is pierced by the hollow needle from flowing to the outside of the case 32.

When the printing operation is performed by the printer 1 (refer to FIG. 1), the ink inside the liquid-holding portion 133 is drawn to the outside of the liquid-holding container 31 through the hollow needle and is discharged from the nozzles of the printer 1. As the ink is drawn out of the liquid-holding portion 133, the shaft portion 43 is moved toward the front by the energizing force of the elastic member 45, rolling up the liquid-holding portion 133 as it moves (refer to FIG. 16D). The curved region 146 (refer to FIG. 4) resists being rolled up, so the movement of the shaft portion 43 stops in the curved region 146. The position where the shaft portion 43 stops is a final position of the movement of the shaft portion 43.

In the present embodiment, the two anti-slip members 360, which are disposed on the left and the right (refer to FIG. 7), support from below the sheet 13B of the liquid-holding bag 13 (refer to FIG. 5) that is contained in the first case 33. The sliding friction between the sheet 13B of the liquid-holding bag 13 and the anti-slip members 360 is great, so the liquid-holding bag 13 does not readily shift to the front, the rear, the left, or the right in the interior of the first case 33. Because the liquid-holding bag 13 does not readily shift to the front, the rear, the left, or the right, the shaft portion 43 is inhibited from shifting to the front, the rear, the left, and the right. Therefore, the shaft portion 43 may roll up the liquid-holding container 31 reliably.

Furthermore, when the liquid-holding container 31 is contained in the first case 33, each one of the anti-slip members 360 supports the liquid-holding container 31 in the range from slightly to the rear of the curved region 146 to slightly in front of the extension portion 134 (refer to FIG. 6). As the shaft body 430 rolls up the liquid-holding portion 133, the diameter of the shaft body 430, which includes the rolled-up liquid-holding portion 133, increases. If the anti-slip members 360 were to be provided toward the front from slightly to the rear of the curved region 146, the sliding friction between the anti-slip members 360 and the liquid-holding portion 133 that is rolled around the shaft body 430 might increase and impede the movement of the shaft portion 43. In the present embodiment, the anti-slip members 360 are not provided toward the front from slightly to the rear of the curved region 146. When the shaft body 430 rolls up the liquid-holding portion 133 all the way to the front end, the entire shaft body 430, including the rolled-up liquid-holding portion 133, is separated from the anti-slip members 360 toward the front. Therefore, the shaft portion 43 is not impeded by the anti-slip members 360 and may roll up the front end of the liquid-holding portion 133 smoothly.

As explained above, the case 32 of the present embodiment is provided with the first case 33, the shaft portion 43, the lower support portions 514, 524, the upper support portions 213, 223, and the switching member 205. The first case 33 is provided with the supporting wall portion 34, the vent plug support portion 37, and the side walls 51, 52. The supporting wall portion 34 is configured to support the liquid-holding container 31. The vent plug support portion 37 is provided on the front end of the supporting wall portion 34 and is configured to support the vent plug 7. The side walls 51, 52 are respectively disposed on the left and right sides of the supporting wall portion 34. The shaft portion 43, which extends to the left and the right, includes the shaft support portions 431, 432. The shaft support portions 431, 432 are substantially coaxial with the shaft portion 43 and project toward the side walls 51, 52, respectively. The elastic member 45 is energized such that a restorative force is generated toward the front. The shaft portion 43, by engaging with the rear end of the elastic member 45, is configured to be moved toward the front by the energizing force of the elastic member 45.

The lower support portions 514, 524 are respectively provided on the side walls 51, 52, extending toward the front and the rear, and they support the shaft support portions 431, 432, respectively. The upper support portions 213, 223 are provided on the opposite sides of the shaft support portions 431, 432 from the lower support portions 514, 524, respectively. The shaft support portions 431, 432 are configured to be held between the upper support portions 213, 223 and the lower support portions 514, 524, respectively. The switching member 205 includes the upper support portions 213, 223 and is configured to switch the positions of the upper support portions 213, 223 between operating positions and released positions. The operating positions are positions where the upper support portion 213 and the lower support portion 514 hold the shaft support portion 431 between them, and the upper support portion 223 and the lower support portion 524 hold the shaft support portion 432 between them. The released positions are positions where the upper support portions 213, 223 are set apart from the shaft support portions 431, 432, respectively.

Accordingly, in a case where the upper support portions 213, 223 have been switched to the operating positions, the movement of the shaft portion 43 is restricted. In that case, the shaft portion 43 resists shifting, even if an external force is applied to the case 32. On the other hand, in a case where the upper support portions 213, 223 have been switched to the released positions, the restriction on the movement of the shaft portion 43 is removed. In that case, the shaft portion 43 energized by the elastic member 45 may roll up the liquid-holding container 31 that is contained in the interior of the case 32. Therefore, the liquid-holding container 31 may be rolled up properly, even in a case where an external force is applied to the case 32.

The switching member 205 includes the presser plates 210, 220, the energizing members 230, 240, and the foot portions 216, 226. The presser plates 210, 220 are disposed in a left-to-right array with the first sections 511, 521, respectively. The presser plates 210, 220 are configured to move between the lowered positions and the raised positions. The lowered positions are the positions where the upper support portions 213, 223 are moved to the operating positions. The raised positions are the positions where the upper support portions 213, 223 are moved to the released positions. The energizing members 230, 240 energize the presser plates 210, 220 to hold the presser plates 210, 220 in the lowered positions. When the presser plates 210, 220 are in the lowered positions, the foot portions 216, 226 project from the first case 33 through the corresponding slits 353, 354 that are formed in the first case 33. When the foot portions 216, 226 are pressed, the presser plates 210, 220 move from the lowered positions to the raised positions against the energizing forces of the energizing members 230, 240.

The presser plates 210, 220 are thus switched to the lowered positions and the raised positions according to whether the foot portions 216, 226 are in an unpressed state or a pressed state. The unpressed state is a state in which the foot portions 216, 226 project from the first case 33 through the corresponding slits 353, 354. The pressed state is a state in which the foot portions 216, 226, which were projecting from the first case 33 through the corresponding slits 353, 354, are being pressed. In this manner, the upper support portions 213, 223 may be switched easily between the operating positions and the released positions.

The presser plates 210, 220 are provided with the slide openings 212, 222, which are openings that extend from the front to the rear. The shaft support portions 431, 432 are configured to move toward the front and the rear inside the slide openings 212, 222. The upper support portions 213, 223 are respectively provided on the upper edges of the slide openings 212, 222 such that that they respectively face the shaft support portions 431, 432. The upper support portions 213, 223 are disposed within the installation spaces for the presser plates 210, 220, so the overall size of the case 32 may be made more compact.

The energizing members 230, 240 are flat springs. The first case 33 includes the holding portions 398, 399, which are provided on the supporting wall portion 34. The anchoring nubs 231, 241 of the energizing members 230, 240 respectively engage with the holding portions 398, 399. The presser plate 210 includes the anchor holes 217, 218, with which the left ends of the energizing members 230, 240 respectively engage. The presser plate 220 includes the anchor holes 227, 228, with which the right ends of the energizing members 230, 240 respectively engage. This simple structure that utilizes flat springs makes it possible for the presser plates 210, 220 to be energized into the lowered positions and for the upper support portions 213, 223 to be held in the operating positions.

The energizing forces by which the energizing members 230, 240 energize the presser plates 210, 220 are, at their greatest, less than the weight of the case 32. Thus, by placing the cartridge 3 such that the foot portions 216, 226 come into contact with a flat surface, the operator may move the presser plates 210, 220 to the raised positions and switch the upper support portions 213, 223 to the released positions.

The shaft support portions 431, 432 are gears around the circumferences of which pluralities of teeth are formed. The upper support portion 213 and the lower support portion 514 are racks along which are formed pluralities of teeth with which the shaft support portion 431 is configured to engage. The upper support portion 223 and the lower support portion 524 are racks along which are formed pluralities of teeth with which the shaft support portion 432 is configured to engage. Accordingly, in a case where the upper support portions 213, 223 have been switched to the operating positions, the rotations of the shaft support portions 431, 432 may be reliably restricted. That means that rotation and shifting of the shaft portion 43 may be prevented more reliably.

It is acceptable for only one of the upper support portion 213 and the lower support portion 514 to be a rack along which are formed a plurality of teeth with which the shaft support portion 431 is configured to engage. It is acceptable for only one of the upper support portion 223 and the lower support portion 524 to be a rack along which are formed a plurality of teeth with which the shaft support portion 432 is configured to engage. Even in those cases, the rotations of the shaft support portions 431, 432 may be reliably restricted when the upper support portions 213, 223 are switched to the operating positions. Furthermore, in the present embodiment, the upper support portions 213, 223 and the lower support portions 514, 524 are formed such that they span the entire front-to-rear range of movement of the shaft portion 43. Therefore, even in a case where the shaft portion 43 has changed due to the amount of ink remaining in the liquid-holding portion 133, the rotations of the shaft support portions 431, 432 may be reliably restricted when the upper support portions 213, 223 are switched to the operating positions.

The second case 60 is configured to slide toward the front and the rear in relation to the first case 33. The latch portion 173 is provided in the second case 60 and projects toward the presser plate 210. The retraction portions 214, 215 are provided in the presser plate 210 and are configured to engage with the latch portion 173. When the presser plate 210 is in the lowered position, the sliding movement of the second case 60 is restricted by the contact between the latch portion 173 and one of the retraction portions 214, 215. When the presser plate 210 is in the raised position, the second case 60 is allowed to slide, because the retraction portions 214, 215 are separated from the latch portion 173. The retraction portions 224, 225, the presser plate 220, and the latch portion 174 have the same sorts of relationships as those described above. Accordingly, in a state in which the rotation of the shaft portion 43 is restricted, the sliding of the second case 60 may be prevented. When the upper support portions 213, 223 have been switched to the released positions, the operator may slide the second case 60.

When the second case 60 is in a position between the starting position and the ending position of its sliding movement (for example, the open position and the closed position), the latch portions 173, 174 support the upper support portions 213, 223, which are in the released positions. When the second case 60 is in at least one of the starting position and the ending position of its sliding movement, the latch portions 173, 174 are separated from the upper support portions 213, 223. Thus, when the second case 60 is sliding, the upper support portions 213, 223 may be prevented from being switched from the released positions to the operating positions. The movement of the shaft portion 43 is not restricted when the second case 60 is sliding, so there is less concern that the sliding of the second case 60 will be impeded.

Figure 17:
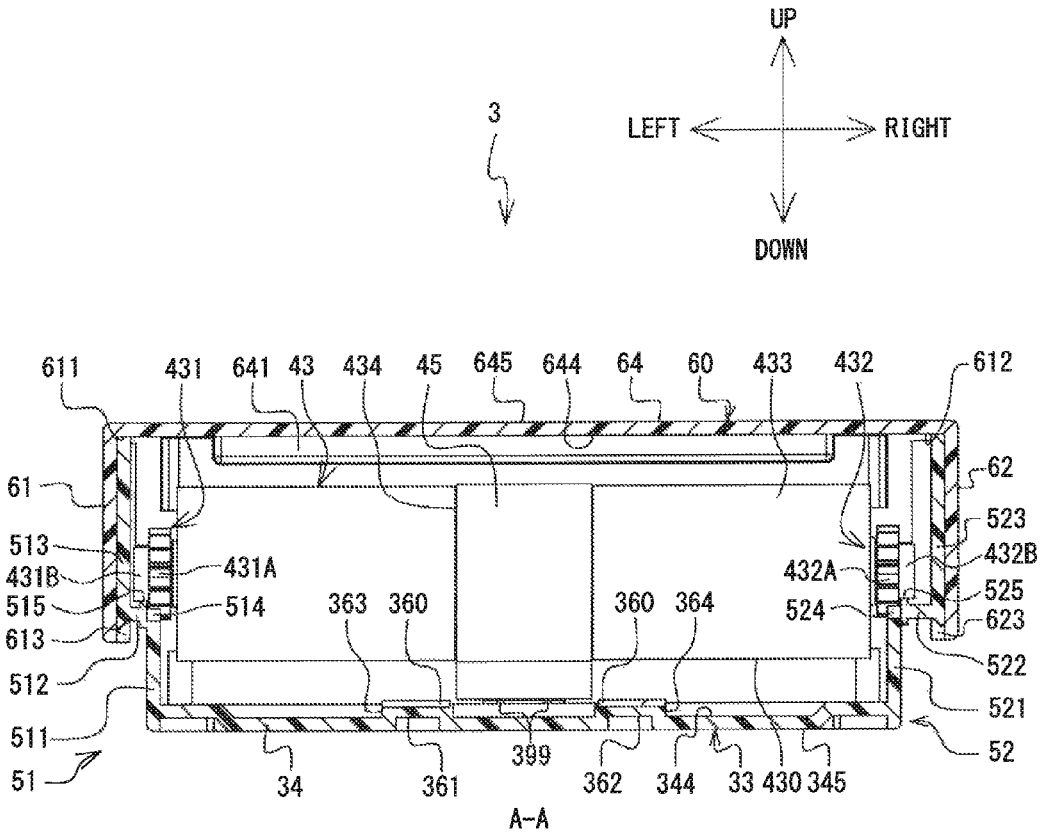
FIG. 17 is a section view from the direction of the arrows on the line A-A in FIG. 2, according to a first modified example.

The present disclosure is not limited to the embodiment that is described above, and various types of modifications can be made. In the explanations that follow for first to third modified examples, structural elements that correspond to the embodiment that is described above use the same reference numerals and will not be explained. Only points that differ from the embodiment that is described above will be explained. The case 32 according to the first modified example will be explained with reference to FIG. 17. The case 32 of the first modified example is not provided with the presser plates 210, 220 (refer to FIG. 6) and the energizing members 230, 240 (refer to FIG. 6). The second case 60 of the first modified example is not provided with the first wall portions 65, 66 (refer to FIG. 10) and the second wall portions 67, 68 (refer to FIG. 10).

In the case 32 of the first modified example, in the same manner as in the embodiment that is described above, the liquid-holding container 31 (refer to FIG. 4) is contained within the case 32. The projecting portions 431B, 432B are respectively disposed on the top sides of the ribs 515, 525. The rotary gears 431A, 432A mesh with the lower support portions 514, 524, which are rack gears, such that the rotary gears 431A, 432A rotate in phase with one another. The shaft portion 43 is moved toward the front by the energizing force of the elastic member 45, rolling up the liquid-holding portion 133 (refer to FIG. 4) as it moves.

According to the first modified example, the shaft support portions 431, 432 are gears around the circumferences of which pluralities of teeth are formed. The lower support portions 514, 524 are racks along which are formed pluralities of teeth with which the shaft support portions 431, 432 are configured to engage. Even in a case where an external force is applied to the case 32, as long as it is a horizontal force or a slight vibration, the shaft portion 43 may be prevented from shifting toward the front and the rear. Therefore, the liquid-holding portion 133 (refer to FIG. 4) may be reliably rolled up inside the case 32, even in a case where an external force is applied.

It is also acceptable for the case 32 of the first modified example not to be provided with the second case 60. The second case 60 of the first modified example may also be provided with the first wall portions 65, 66 (refer to FIG. 10) and the second wall portions 67, 68 (refer to FIG. 10). In that case, the shaft support portion 431 would be disposed in a space bounded by the first wall portion 65, the second wall portion 67, and the lower support portion 514. The shaft support portion 432 would be disposed in a space bounded by the first wall portion 66, the second wall portion 68, and the lower support portion 524. In this manner, the shaft portion 43 may be more reliably prevented from shifting, even in a case where an external force is applied to the case 32.

Figure 18:
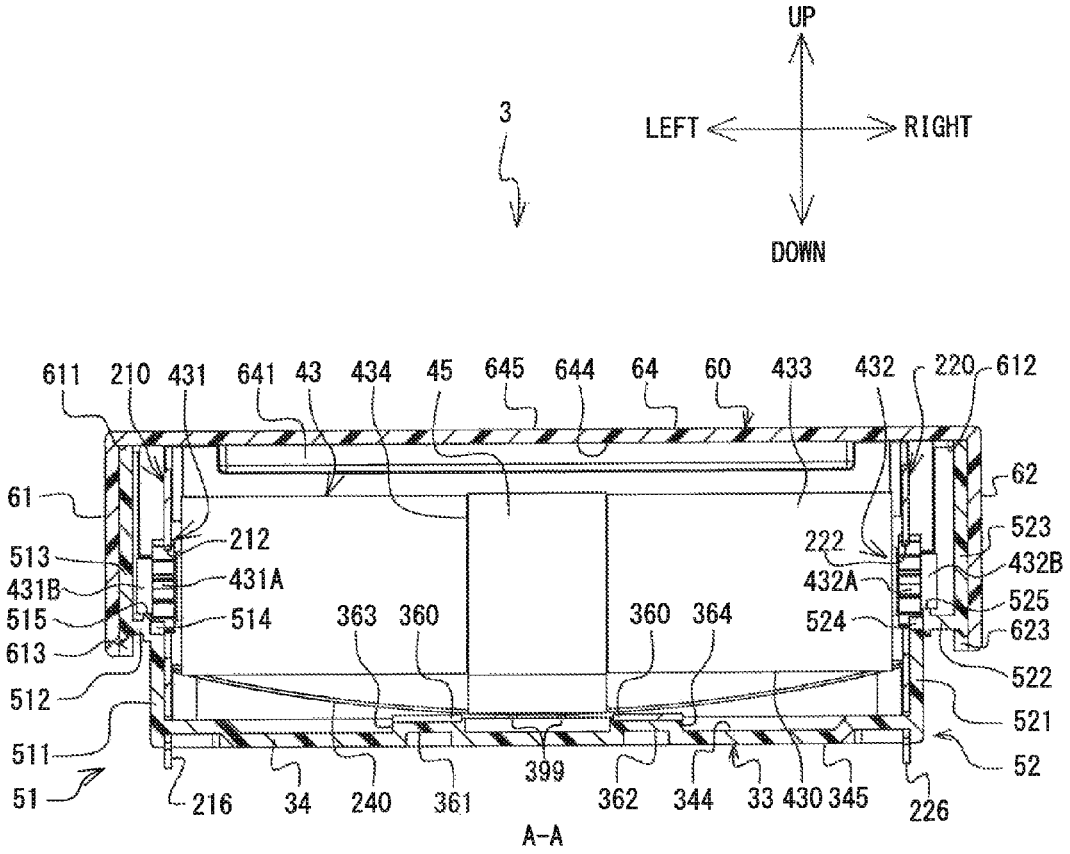
FIG. 18 is a section view from the direction of the arrows on the line A-A in FIG. 2, according to a second modified example.

The case 32 according to the second modified example will be explained with reference to FIG. 18. The case 32 of the second modified example is not provided with the first wall portions 65, 66 (refer to FIG. 10). Even so, the case 32 of the second modified example is provided with the presser plates 210, 220, so it achieves the same sort of effects as the embodiment that is described above. That is, in a case where the upper support portions 213, 223 (refer to FIG. 6) have been switched to the operating positions, the movement of the shaft portion 43 is restricted, so the shaft portion 43 resists shifting, even if an external force is applied to the case 32. In a case where the upper support portions 213, 223 have been switched to the released positions, the shaft portion 43 energized by the elastic member 45 may roll up the liquid-holding container 31 (refer to FIG. 12) properly, even if an external force is applied to the case 32.

Figure 19:
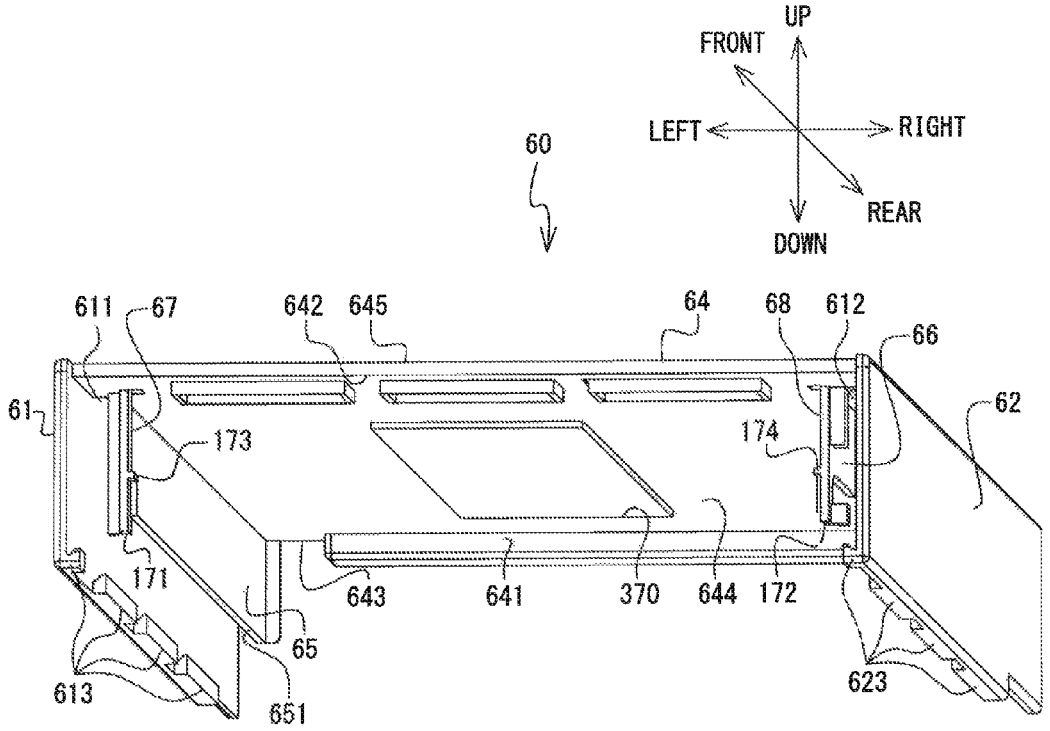
FIG. 19 is an oblique view of the second case, according to a third modified example.
Figure 20:
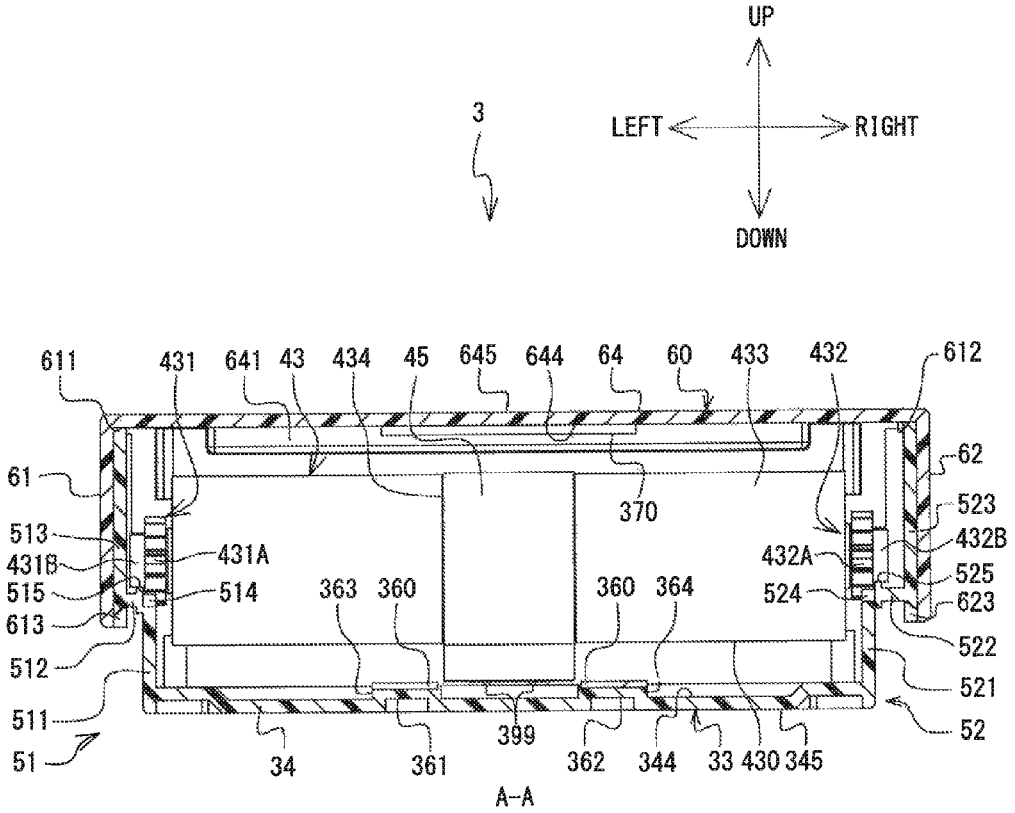
FIG. 20 is a section view from the direction of the arrows on the line A-A in FIG. 2, according to the third modified example.

The case 32 according to the third modified example will be explained with reference to FIGS. 19 and 20. In the second case 60 of the third modified example, an anti-slip member 370, which is a rubber sheet, is affixed to the second inner face 644. The anti-slip member 370 is located substantially in the center of the left-right direction of the second inner face 644 and extends toward the front and the rear. The anti-slip member 370 is positioned opposite the liquid-holding container 31, which is contained in the first case 33, over a range that extends from slightly to the rear of the curved region 146 to slightly in front of the extension portion 134. The rotary gears 431A, 432A may also be discs that have smooth circumferential faces. The lower support portions 514, 524 may also be flat plates that extend toward the front and the rear.

The case 32 of the third modified example is provided with the anti-slip members 360, in the same manner as the embodiment that is described above, so the liquid-holding bag 13 (refer to FIG. 12) resists shifting toward the front and the rear and toward the left and the right in the interior of the first case 33. Furthermore, in some cases, the operator may turn the case 32 upside down and shake the cartridge 3 in order to agitate the ink inside the liquid-holding portion 133 (refer to FIG. 4), for example. In those cases, in the interior of the first case 33, the liquid-holding bag 13 lifts up from the supporting wall portion 34 and comes into contact with the anti-slip member 370 on the second inner face 644. At this time, the anti-slip member 370 prevents the liquid-holding bag 13 from shifting toward the front and the rear and toward the left and the right, so the shifting of the shaft portion 43 toward the front and the rear and toward the left and the right is inhibited. Therefore, the shaft portion 43 may roll up the liquid-holding container 31 reliably.

Modifications like those described below are also possible. It is acceptable to provide only one of the mechanism that restricts the movement of the shaft portion 43 on the left side of the case 32 (the upper support portion 213, the lower support portion 514, the rotary gear 431A, and the like) and the mechanism that restricts the movement of the shaft portion 43 on the right side of the case 32 (the upper support portion 223, the lower support portion 524, the rotary gear 432A, and the like). It is acceptable to provide only one of the mechanism that restricts the sliding movement of the second case 60 on the left side of the case 32 (the retraction portions 214, 215, the latch portion 173, and the like) and the mechanism that restricts the sliding movement of the second case 60 on the right side of the case 32 (the retraction portions 224, 225, the latch portion 174, and the like).

The upper support portion 213 is not limited to being a rack, and it may be any member (for example, an elastic member made of rubber, resin, or the like) that is configured to restrict the rotation of the rotary gear 431A. The same is true of the upper support portion 223. The lower support portion 514 is not limited to being a rack, and it may be any member (for example, a flat plate that extends toward the front and the rear) that is configured to support the rotary gear 431A. The same is true of the lower support portion 524. The rotary gear 431A is not limited to being a disc-shaped gear, and it may be any member (for example, a disc or a circular cylinder that has a smooth circumferential face) that is configured to move along the lower support portion 514. The same is true of the rotary gear 432A.

It is also acceptable for the case 32 not to be provided with the latch portions 173, 174. In that case, when the case 32 is lifted off of a flat surface, the presser plates 210, 220 move to the lowered positions, and the sliding movement of the second case 60 is restricted, even in a case where the second case 60 is between the closed position and the open position.

Instead of the latch portion 173, a first latch portion and a second latch portion may be provided separately. The first latch portion is a component that, when the second case 60 is between the closed position and the open position, latches such that the presser plate 210 does not move to the lowered position. The second latch portion is a component that, when the second case 60 is in one of the closed position and the open position, latches such that the second case 60 does not slide. It is also acceptable for at least one of the first latch portion and the second latch portion to be provided instead of the latch portion 173. The above also holds true for the latch portion 174.

It is acceptable for only one of the foot portions 216 to be provided in the presser plate 210, and it is also acceptable for more than two of the foot portions 216 to be provided in the presser plate 210. The foot portions 216 may also be provided such that they project from the case 32 in one of the upward direction, the forward direction, the rearward direction, the leftward direction, and the rightward direction, instead of projecting downward from the case 32. In a case where the foot portions 216 project from the case 32 in the forward direction, for example, the presser plate 210 may shift between the raised position and the lowered position in accordance with the operating of the foot portions 216 upward and downward by the operator. The above also holds true for the foot portions 226.

It is also acceptable for the upper support portion 213 not to be provided in the presser plate 210. For example, the upper support portion 213 may also be provided as a single, independent member, and it may also be provided in a different member from the presser plate 210. The upper support portion 213 may also be moved to the operating position and the released position by one of a mechanical and an electrical mechanism, in response to an operation of a button (not shown in the drawings) that is provided on a side face of the case 32. The above also holds true for the upper support portion 223.

Instead of being flat springs, the energizing members 230, 240 may be other elastic bodies (for example, coil springs). The energizing members 230, 240 may also be formed as a single unit with the first case 33, instead of as separate pieces from the first case 33. The shaft support portion 431 is provided with the rotary gear 431A and the projecting portion 431B, but it may also be provided with only the rotary gear 431A. The shaft support portion 432 is provided with the rotary gear 432A and the projecting portion 432B, but it may also be provided with only the rotary gear 432A.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A cartridge case comprising:

a case body provided with a bottom wall, a support portion, and a pair of side walls, the bottom wall being configured to support a liquid-holding container containing a liquid, the bottom wall having a first end portion and a second end portion at opposite ends of the bottom wall, the support portion being provided in the first end portion and configured to support a hollow vent plug provided in the liquid-holding container, and the pair of the side walls facing one another from opposite sides of the bottom wall;

a shaft portion extending in a first direction, the first direction being the direction in which the pair of the side walls face one another, the shaft portion including a shaft support portion and engaging with an end portion on a second direction side of an elastic member, the second direction being a direction from the first end portion toward the second end portion and orthogonal to the first direction, the shaft support portion being coaxial with the shaft portion and projecting toward the pair of the side walls, the elastic member extending in the second direction and being energized to generate a restorative force in a third direction, the third direction being the opposite direction from the second direction, and the shaft portion being configured to be moved in the third direction by an energizing force of the elastic member;

a first support portion provided on at least one of the pair of the side walls, the first support portion extending in the second direction and being configured to support the shaft support portion;

a second support portion provided on the opposite side of the shaft support portion from the first support portion, the second support portion and the first support portion being configured to hold the shaft support portion between the second support portion and the first support portion; and a switching member having the second support portion, the switching member being configured to switch a position of the second support portion between an operating position and a released position, the operating position being a position where the second support portion and the first support portion hold the shaft support portion between the second support portion and the first support portion, and the released position being a position where the second support portion has moved away from the shaft support portion.

2. The cartridge case according to claim 1, wherein the switching member includes a movable body arrayed in the first direction in relation to at least one of the pair of the side walls, the movable body being configured to move between a first position and a second position, the first position being a position where the second support portion moves to the operating position, and the second position being a position where the second support portion moves to the released position, an energizing member configured to hold the movable body in the first position by energizing the movable body, and a projecting portion configured to project from the case body through an opening formed in the case body in a case where the movable body is in the first position.

3. The cartridge case according to claim 2, wherein the movable body moves from the first position to the second position against the energizing force of the energizing member in a case where the projecting portion is pressed.

4. The cartridge case according to claim 2, wherein the movable body includes a slide opening, the slide opening being an opening extending in the second direction, the shaft support portion is configured to move in the second direction inside the slide opening, and the second support portion is provided on a target edge portion among the edge portions forming the slide opening, the target edge portion being opposite the shaft support portion.

5. The cartridge case according to claim 4, further comprising:

a case cover having a top wall, the top wall being opposite the bottom wall; and wherein the target edge portion is on the top wall side of the slide opening.

6. The cartridge case according to claim 5, wherein the edge portions forming the slide opening including a first edge portion, a second edge portion, and a third edge portion, the first edge portion being on the top wall side and the second direction end of the slide opening, the second edge portion being on the top wall side and the third direction end of the slide opening, the third edge portion being on the top wall side of the slide opening and located between the first edge portion and the second edge portion, the first edge portion and the second edge portion being closer to the top wall than is the third edge portion, and the target edge portion is the third edge portion.

7. The cartridge case according to claim 2, wherein the energizing member is a flat spring, the case body includes a first spring engagement portion, the first spring engagement portion being provided in the bottom wall and configured to engage with a first part of the energizing member, and the movable body includes a second spring engagement portion, the second spring engagement portion being configured to engage with a second part of the energizing member.

8. The cartridge case according to claim 7, wherein the first part is in the central portion of the energizing member in the first direction, and the second part is in the end portion of the energizing member in the first direction.

9. The cartridge case according to claim 7, wherein the energizing force by which the energizing member energizes the movable body is less than the weight of the cartridge case.

10. The cartridge case according to claim 2, further comprising:

a case cover configured to slide in the second direction and the third direction in relation to the case body;

a projecting member provided in the case cover and projecting toward the movable body; and an engagement portion provided in the movable body, the engagement portion being a portion configured to engage with the projecting member, wherein the engagement portion is in contact with the projecting member in a case where the movable body is in the first position, the engagement portion contacted by the projecting member being configured to restrict the sliding of the case cover in the second direction and the third direction, and the engagement portion is separated from the projecting member in a case where the movable body is in the second position, the engagement portion separated from the projecting member being configured to allow the sliding of the case cover in the second direction and the third direction.

11. The cartridge case according to claim 2, further comprising:

a case cover configured to slide between a starting position and an ending position in the second direction and the third direction in relation to the case body; and a projecting member provided in the case cover and projecting toward the movable body, wherein the projecting member, in a case where the case cover is in a position between the starting position and the ending position, supports the second support portion being in the released position, and the projecting member is separated from the second support portion in a case where the case cover is in one of the starting position and the ending position.

12. The cartridge case according to claim 1, wherein the shaft support portion is a gear, and the first support portion is a rack, the rack having a plurality of teeth along the second direction, the plurality of teeth being configured to engage with the shaft support portion.

13. The cartridge case according to claim 1, wherein the shaft support portion is a gear, and the second support portion is a rack, the rack having a plurality of teeth along the second direction, the plurality of teeth being configured to engage with the shaft support portion.

14. A cartridge case comprising:

a case body provided with a bottom wall, a support portion, and a pair of side walls, the bottom wall being configured to support a liquid-holding container containing a liquid, the bottom wall having a first end portion and a second end portion at opposite ends of the bottom wall, the support portion being provided in the first end portion and configured to support a hollow vent plug provided in the liquid-holding container, and the pair of the side walls facing one another from opposite sides of the bottom wall;

a shaft portion extending in a first direction, the first direction being the direction in which the pair of the side walls face one another, the shaft portion including a shaft support portion and engaging with an end portion on a second direction side of an elastic member, the second direction being a direction from the first end portion toward the second end portion and orthogonal to the first direction, the shaft support portion being a gear that is coaxial with the shaft portion and that projects toward the pair of the side walls, the elastic member extending in the second direction and being energized to generate a restorative force in a third direction, the third direction being the opposite direction from the second direction, and the shaft portion being configured to be moved in the third direction by an energizing force of the elastic member; and a first support portion provided on at least one of the pair of the side walls, the first support portion extending in the second direction, the first support portion being configured to support the shaft support portion, the first support portion being a rack, the rack having a plurality of teeth along the second direction, the plurality of teeth being configured to engage with the shaft support portion.

15. A cartridge case comprising:

a case body provided with a bottom wall, a support portion, and a pair of side walls, the bottom wall being configured to support a liquid-holding container containing a liquid, the bottom wall having a first end portion and a second end portion at opposite ends of the bottom wall, the support portion being provided in the first end portion and configured to support a hollow vent plug provided in the liquid-holding container, and the pair of the side walls facing one another from opposite sides of the bottom wall;

a shaft portion extending in a first direction, the first direction being the direction in which the pair of the side walls face one another, the shaft portion including a shaft support portion and engaging with an end portion on a second direction side of an elastic member, the second direction being a direction from the first end portion toward the second end portion and orthogonal to the first direction, the shaft support portion being coaxial with the shaft portion and projecting toward the pair of the side walls, the elastic member extending in the second direction and being energized to generate a restorative force in a third direction, the third direction being the opposite direction from the second direction, and the shaft portion being configured to be moved in the third direction by an energizing force of the elastic member;

a first support portion provided on at least one of the pair of the side walls, the first support portion extending in the second direction and being configured to support the shaft support portion; and a first anti-slip member provided in the bottom wall, the first anti-slip member being configured to support the liquid-holding container along the second direction.

16. The cartridge case according to claim 15, further comprising:

a case cover having a top wall, the top wall being opposite the bottom wall; and a second anti-slip member provided in the top wall, the second anti-slip member being disposed opposite the liquid-holding container along the second direction.

* * * * *